US008534881B2

(12) United States Patent
Howe

(10) Patent No.: US 8,534,881 B2
(45) Date of Patent: Sep. 17, 2013

(54) LIGHT REFLECTOR CONE

(71) Applicant: Southpac Trust International Inc, Trustee of the LDH Trust, Rarotonga (CK)

(72) Inventor: Leslie David Howe, Atlanta, GA (US)

(73) Assignee: Southpac Trust International Inc., Rarotonga, Cook Islands, Trustee of the LDH Trust ( * ) Notice: Subject to any disclaimer, the term of this patent is extended or adjusted under 35 U.S.C. 154(b) by 0 days.

(21) Appl. No.: 13/718,013

(22) Filed: Dec. 18, 2012

(65) Prior Publication Data

US 2013/0188362 A1 Jul. 25, 2013

Related U.S. Application Data

(60) Provisional application No. 61/632,310, filed on Jan. 23, 2012, provisional application No. 61/633,858, filed on Feb. 21, 2012, provisional application No. 61/687,374, filed on Apr. 25, 2012, provisional application No. 61/742,046, filed on Aug. 2, 2012.

(51) Int. Cl.
*F21V 1/00* (2006.01)

(52) U.S. Cl.
USPC ..... 362/356; 362/355

(58) Field of Classification Search
USPC ..... 362/351, 353, 355, 356, 360, 361
See application file for complete search history.

(56) References Cited

U.S. PATENT DOCUMENTS

| | | | | |
|---|---|---|---|---|
| 2,304,458 | A * | 12/1942 | Hauskind | 362/356 |
| 4,383,291 | A * | 5/1983 | Gall | 362/352 |
| 4,392,190 | A * | 7/1983 | Upton | 362/281 |
| 7,264,380 | B1 * | 9/2007 | Monroe et al. | 362/352 |
| 2009/0059597 | A1 | 3/2009 | Chuang | |

FOREIGN PATENT DOCUMENTS

| | | |
|---|---|---|
| SE | WO9837359 | 8/1998 |

* cited by examiner

*Primary Examiner* — Laura Tso
(74) *Attorney, Agent, or Firm* — Troutman Sanders, LLP; James E. Schutz; Mark Lehi Jones

(57) ABSTRACT

Certain embodiments of the disclosed technology may include systems and apparatus for providing a light reflector, light fixture, light fixture retrofit apparatus, lamp reflector, lamp retrofit apparatus or luminaire reflector retrofit. According to an example embodiment of the disclosed technology, a light reflector is provided that includes two or more nested cone-shaped layers configured for reflecting light from a light source placed in proximity to the inner cone portion. The two or more nested cone-shaped layers include a reflection layer disposed adjacent to an outer cone portion of the layers. The two or more nested cone-shaped layers further include a lenticular optical film disposed between the reflection surface of the reflection layer and an inner cone portion.

27 Claims, 32 Drawing Sheets

CHARACTERISTICS

| | |
|---|---|
| Lumens Per Lamp | 1800 (1 lamp) |
| Total Lamp Lumens | 1800 |
| Luminaire Lumens | 1638 |
| Total Luminaire Efficiency | 91 % |
| Luminaire Efficacy Rating (LER) | 71 |
| Total Luminaire Watts | 23.2 |
| Ballast Factor | 1.00 |
| CIE Type | Direct |
| Spacing Criterion (0-180) | 0.92 |
| Spacing Criterion (90-270) | 0.92 |
| Spacing Criterion (Diagonal) | 0.92 |
| Basic Luminous Shape | Circular |
| Luminous Length (0-180) | 0.50 ft (Diameter) |
| Luminous Width (90-270) | 0.50 ft (Diameter) |
| Luminous Height | 0.00 ft |

FIG 5A

CANDELA TABULATION

| | 0 |
|---|---|
| 0.0 | 1513.434 |
| 2.5 | 1506.322 |
| 5.0 | 1494.942 |
| 7.5 | 1482.141 |
| 10.0 | 1449.426 |
| 12.5 | 1398.219 |
| 15.0 | 1331.366 |
| 17.5 | 1247.445 |
| 20.0 | 1157.834 |
| 22.5 | 1066.800 |
| 25.0 | 970.077 |
| 27.5 | 866.242 |
| 30.0 | 763.829 |
| 32.5 | 657.149 |
| 35.0 | 559.003 |
| 37.5 | 465.125 |
| 40.0 | 382.626 |
| 42.5 | 311.506 |
| 45.0 | 251.765 |
| 47.5 | 199.136 |
| 50.0 | 155.042 |
| 52.5 | 119.482 |
| 55.0 | 91.034 |
| 57.5 | 69.698 |
| 60.0 | 52.629 |
| 62.5 | 41.250 |
| 65.0 | 32.715 |
| 67.5 | 27.026 |
| 70.0 | 21.336 |
| 72.5 | 17.069 |
| 75.0 | 14.224 |
| 77.5 | 9.957 |
| 80.0 | 8.534 |
| 82.5 | 5.690 |
| 85.0 | 4.267 |
| 87.5 | 1.422 |
| 90.0 | 0.000 |

FIG 5B

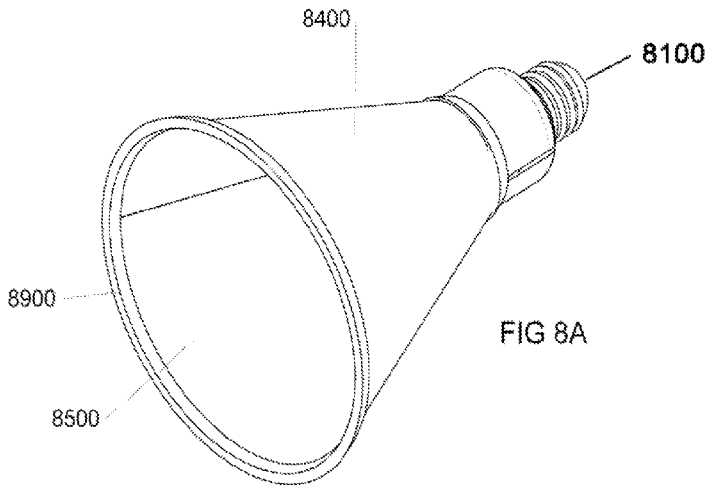
FIG 8A
FIG 8B
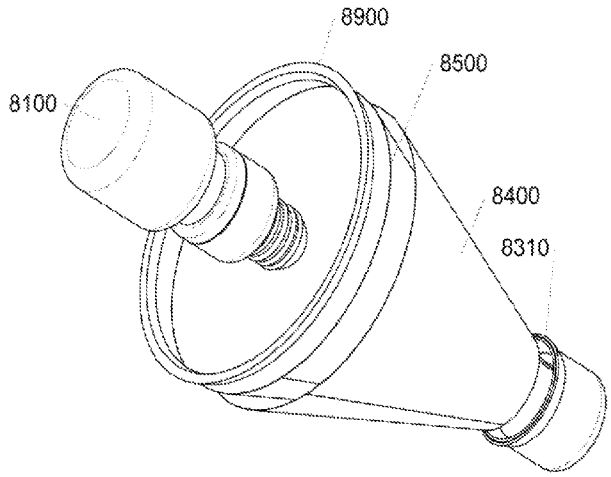

FIG 9A
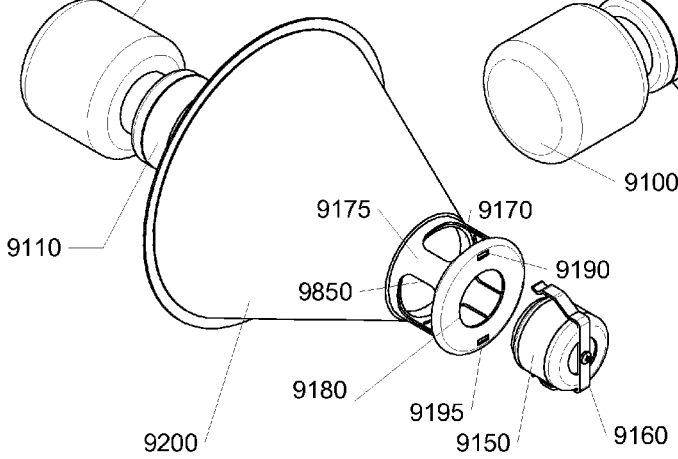
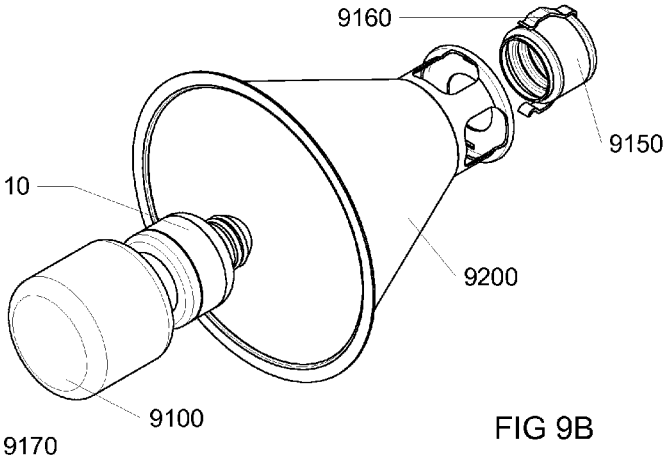
FIG 9B
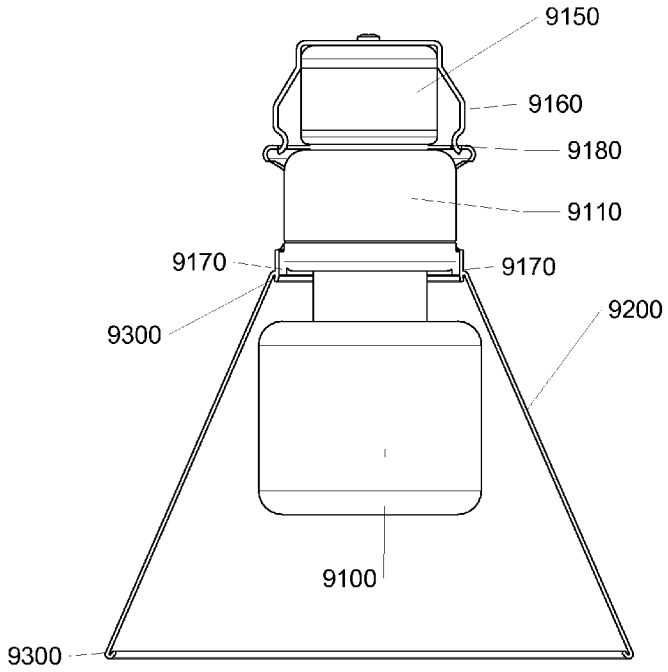
FIG 9C

1470

1471
BA
BA 1472
1480
P 1473
1480
P
BA
BA 1474
1490

1475
1490
BA
BA

LIGHT REFLECTOR CONE

RELATED APPLICATIONS

This application claims the benefit of U.S. Provisional Patent Application No. 61/632,310 entitled "Light Reflector Cone" filed Jan. 23, 2012, and U.S. Provisional Patent Application No. 61/633,858 entitled "Light Reflector Cone" filed Feb. 21, 2012, and Provisional Patent Application No. 61/687,374 entitled "Light Reflector Cone" filed Apr. 25, 2012, and U.S. Provisional Patent Application No. 61/742,046 entitled "Light Reflector Cone" filed Aug. 2, 2012, the contents of which are each incorporated herein by reference in their entirety, as if set forth in full.

TECHNICAL FIELD

The disclosed technology generally relates to light reflection, and in particular to light reflectors for luminaires.

BACKGROUND

Recessed "downlight" luminaires, sometimes referred to as "pot lights" or "can lights," are widely used in commercial and residential lighting applications. The luminaries typically consist of an outer enclosure or housing, a light source inside the housing, and a reflector to help direct light out of the luminaire. The reflectors are available in a multitude of shapes and designs intended for various applications, and can typically have a specular reflection surface such as polished metal, a diffuse reflection surface such as a white painted surface, or a diffuse/specular reflection surface such as brushed or coated aluminum.

When light sources, such as compact fluorescent lamps or LEDs (light emitting diodes) with broad distribution patterns are used in downlights, luminaire efficiency tends to be relatively low, with an average efficiency typically less than 60%, which may be due to light losses within the reflector. The possible range of sizes and shapes of reflector design are typically limited by the geometry of the housing, lamp placement, and the luminaire's light distribution considerations. A large percentage of light emitted from the light source may become "trapped" within the reflector and may be significantly attenuated by multiple reflections before exiting the luminaire.

BRIEF SUMMARY

One example embodiment of the disclosed technology is directed to a hollow cone-shaped light reflector apparatus comprising two or more nested cone-shaped layers defining a top cone portion having a substantially circular top aperture, and a bottom cone portion having a substantially circular bottom optical aperture that is larger in diameter than the top aperture. In an example embodiment, the nested cone-shaped layers define an inner cone portion, and an outer cone portion. The two or more nested cone-shaped layers are configured for reflecting light from a light source placed in proximity to the inner cone portion. The two or more nested cone-shaped layers include a reflection layer and a lenticular optical film layer. The reflection layer is disposed adjacent to the outer cone portion, and the reflection layer has at least a reflection surface that is oriented facing the inner cone portion. The lenticular optical film layer is disposed between the reflection surface of the reflection layer and the inner cone portion. In one embodiment, the lenticular optical film layer includes a structured surface and a smooth surface. In an example implementation, the structured surface is oriented facing the inner cone portion. In another example implementation, the structured surface is oriented facing the outer cone portion.

An example embodiment is directed to a system that includes a light fixture enclosure cavity and two or more nested cone-shaped layers. The two or more nested cone-shaped layers include a top cone portion having a substantially circular top aperture, a bottom cone portion having a substantially circular bottom optical aperture that is larger in diameter than the top aperture, an inner cone portion, and an outer cone portion. The two or more nested cone-shaped layers are configured for reflecting light from a light source placed in proximity to the inner cone portion. The two or more nested cone-shaped layers include a reflection layer and a lenticular optical film layer. The reflection layer is disposed adjacent to the outer cone portion, and the reflection layer includes at least a reflection surface that is oriented facing the inner cone portion. The lenticular optical film layer is disposed between the reflection surface of the reflection layer and the inner cone portion. In one embodiment, the lenticular optical film layer includes a structured surface and a smooth surface. In an example implementation, the structured surface is oriented facing the inner cone portion. In another example implementation, the structured surface is oriented facing the outer cone portion.

An example embodiment of the disclosed technology includes an optical film support system that includes a hollow cone-shaped structure having a top aperture and a bottom aperture that is larger than the top aperture. The hollow cone shape structure further includes one or more channels disposed along an inner periphery of the hollow cone shaped structure at the bottom aperture, wherein the one or more channels are configured to secure optical film.

BRIEF DESCRIPTION OF THE FIGURES

Reference will now be made to the accompanying tables and drawings, which are not necessarily drawn to scale, and wherein:

FIGS. 1B-2 depicts an example cutaway isometric side view close up of the inside of the reflector cone of the example embodiment depicted in FIG. 1A, showing optical films nesting in the bottom film channel.

FIGS. 2B-1 depicts an exploded perspective view of an example embodiment of a cone shaped light reflector having a reflection film and a lenticular optical film.

FIGS. 2B-2 depicts an exploded perspective view of an example embodiment of a cone shaped light reflector having a lenticular optical film.

FIGS. 2F-2 depicts an example optical film cutting template or an example cut piece of prismatic optical film with arrows indicating the alignment of the prism feature rows, which may result in a prism row alignment that is substantially perpendicular with respect to the optical axis of the fixture when formed into a cone shape.

FIG. 5A shows photometric test data for an example embodiment of the disclosed technology.

FIG. 5B shows photometric test data for a commercially available cone reflector of a similar shape as the example embodiment of the disclosed technology of FIG. 5A.

FIG. 8A, depicts a perspective view of an example embodiment of lamp reflector or lamp retrofit apparatus with no optical film support structure.

FIG. 8B depicts a perspective exploded view of an example embodiment of lamp reflector or lamp retrofit apparatus with no optical film support structure.

FIG. 9A depicts a perspective view of an example embodiment of lamp reflector or lamp retrofit apparatus suitable for use with a CFL with integral ballast.

FIG. 9B depicts another perspective view of an example embodiment of lamp reflector or lamp retrofit apparatus suitable for use with a CFL with integral ballast.

FIG. 9C depicts a cross sectional cutaway view of the example embodiment of lamp reflector or lamp retrofit apparatus depicted in FIGS. 9A and 9B, which is suitable for use with a CFL with integral ballast.

DETAILED DESCRIPTION OF THE DISCLOSED TECHNOLOGY

Embodiments of the disclosed technology will be described more fully hereinafter with reference to the accompanying drawings in which embodiments of the disclosed technology are shown. This disclosed technology, however, may be embodied in many different forms and should not be construed as limited to the embodiments set forth herein; rather, these embodiments are provided so that this disclosure will be thorough and complete, and will fully convey the scope of the disclosed technology to those skilled in the art.

Various example embodiments of a light reflector will now be described which may be suitable for use as a reflector for a light source that may be disposed inside, or in proximity to the inside of the reflector, and the light source may include a compact fluorescent lamp, LED, or incandescent lamp for example. The example embodiments of light reflector that will now be described may have some or all of the following advantages over other light reflectors, including reflectors that may have high efficiency specular reflection surfaces, or high efficiency diffuse reflection surfaces:

a. A higher efficiency reflector with lower light losses due to absorption.
b. Able to significantly condense the beam angle of a light source, such as a compact fluorescent lamp (CFL), with less light loss due to absorption.
c. Increased illuminance levels.
d. Lower cost of manufacturing.
e. Decreased high angle glare compared to reflectors with diffuse reflecting surfaces.
f. The beam angle can be adjusted without changing the shape of the reflector.
g. Can be configured as a retrofit insert that may be attached to the inside of an existing commercially available reflector or attached to a lamp.

Figure 1A:
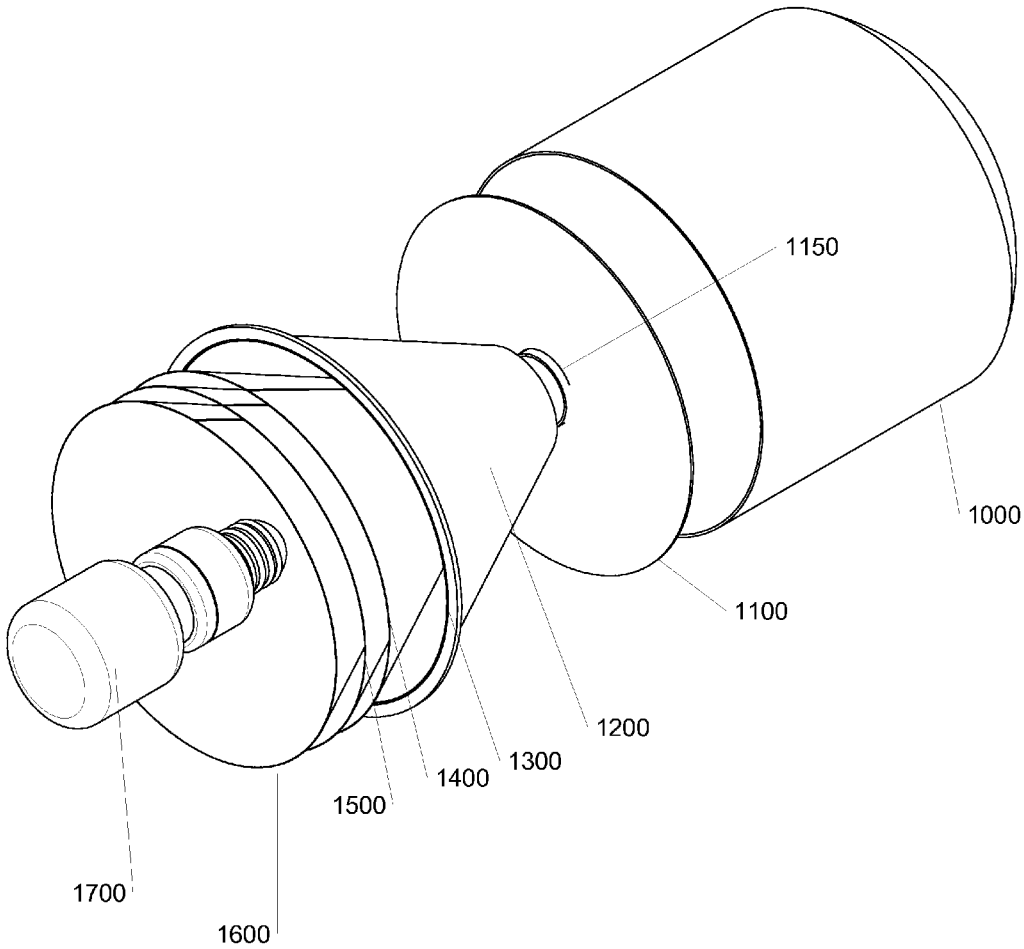
FIG. 1A depicts an exploded perspective view of an example embodiment of light fixture with reflector cone.
Figures 1, 1B:
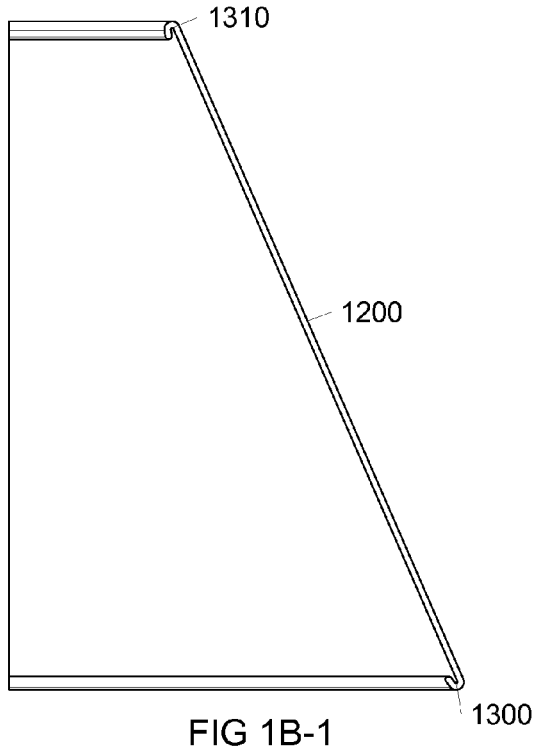
FIGS. 1B-1 depicts an example cutaway side view of a portion of the inside of the reflector cone of the example embodiment depicted in FIG. 1A, showing the top and bottom film channels.
Figure 2A:
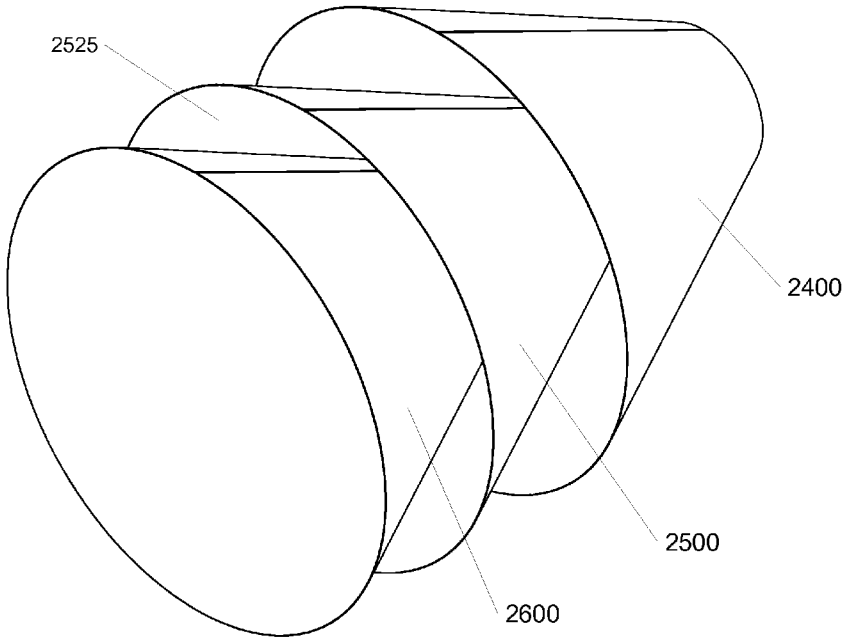
FIG. 2A depicts an exploded perspective view of an example embodiment of a nested cone-shaped light reflector having a reflection film, a lenticular optical film, and a diffusion film.
Figures 1, 2B:
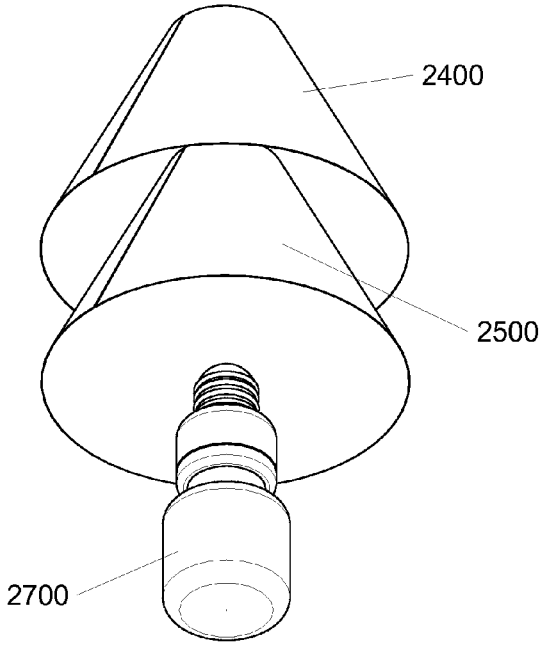
Figures 2, 2B:
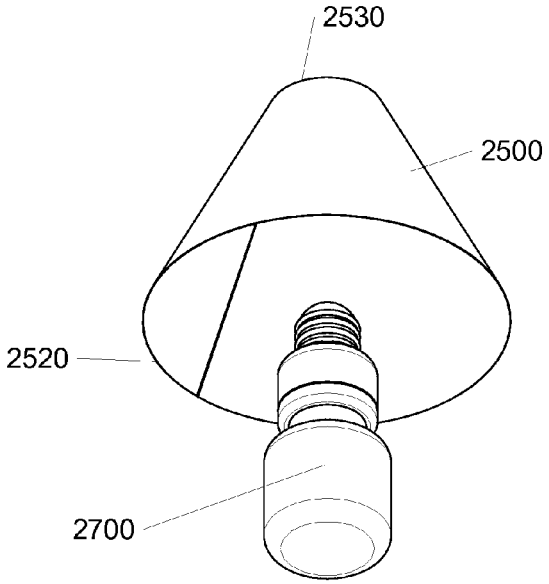

An example embodiment of a reflector is shown in FIGS. 2B-1, wherein a lenticular optical film (2500) and reflection film (2400) form a hollow cone-shaped light reflector. The lenticular optical film (2500) may comprise a prismatic optical film such as BEF II film manufactured by 3M, which includes rows of triangular prisms with 90-degree apexes. Although other types of lenticular films or holographic films may be utilized in any of the example embodiments, and may function adequately or possibly in a superior fashion, a prismatic film such as BEF II manufactured by 3M may be utilized, and should not be construed to limit the scope of use of other types of lenticular or holographic optical films. Prismatic lenticular optical film may have the advantage of lower cost, due to its widespread use and demand, as well as excellent optical performance in example embodiments.

The orientation of the prism rows on lenticular optical film utilized and described herein in certain example embodiments may have an effect on the reflection and refraction properties of the example light reflector embodiment, which will be described in further detail below. For purposes of future reference, a description of terminology and frame of reference for the orientation of the prism rows will now be provided.

Figure 10:
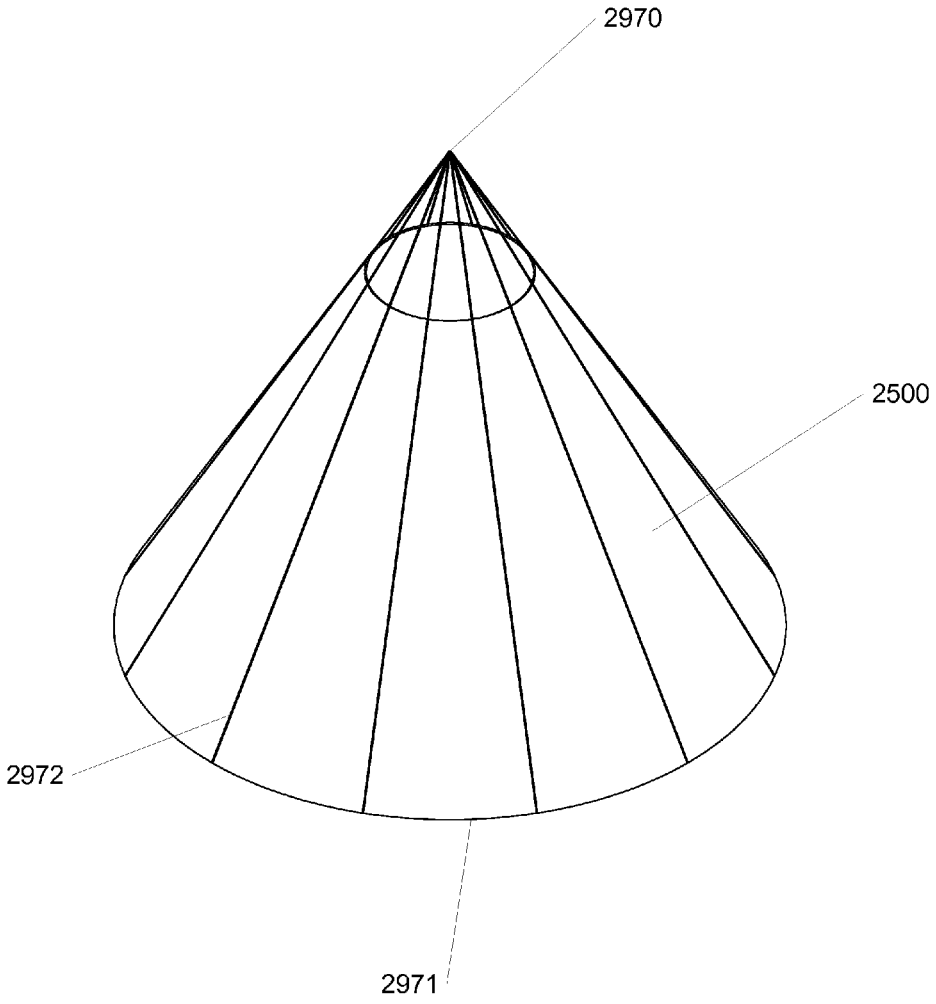
FIG. 10 depicts an optical film piece formed into a cone, which further depicts theoretical line segments and cone apex.

Referring to FIG. 10, a piece of optical film may be configured, cut, and subsequently formed into a portion of a hollow cone shape. The cone shape 2500 may include an apex 2970, and the surface of cone shape 2500 may be defined by a union of all straight-line segments 2972 joining the apex 2970 and the perimeter of the base 2971 of the cone shape 2500. All subsequent references to the prism row alignment on lenticular optic film layers will be as follows:

A) When at least a portion of the prism rows of the lenticular optical film layer are aligned relatively parallel to one or more of the straight-line segments 2972, then the prism rows will be referred to as having a "vertical alignment".

B) When at least a portion of the prism rows of the optical film layer are aligned relatively perpendicular to one or more of the straight-line segments, then the prism rows will be referred to as having a "horizontal alignment".

Figures 1, 1B, 2:
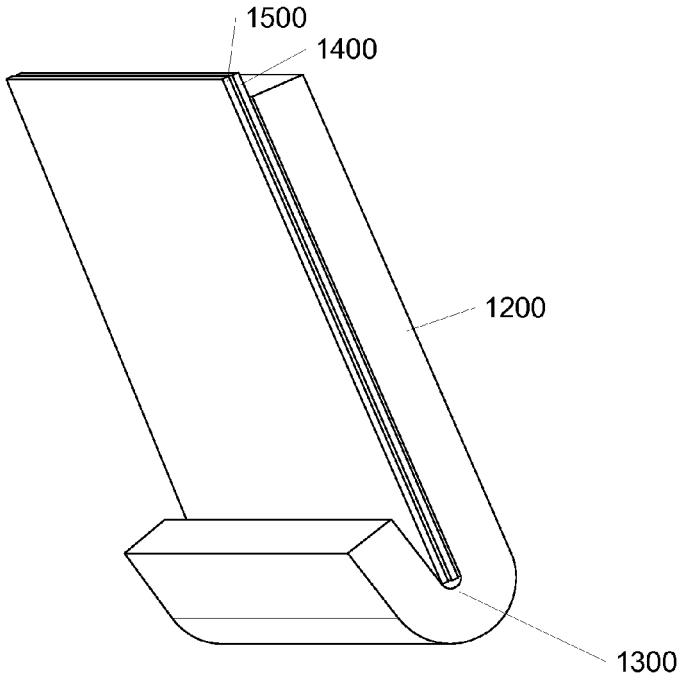

Referring to FIGS. 2B-2, a light source (2700) may be disposed or arranged in near proximity to the small opening of the cone (2530), with the light source (2700) being preferably aimed towards the center of the large opening of the cone (2520). Such a light source may comprise a compact fluorescent lamp, an incandescent lamp, or an LED lamp etc. An example embodiment of reflector as described may enhance the light output efficiency of the light source by reflecting, diffracting, and/or redirecting light towards the larger opening of the cone reflector assembly.

The reflective and refractive properties of flat prismatic optical film are well documented and understood to those skilled in the arts, from both the perspectives of light incident on the structured surface, and light incident on the smooth surface, and will not be discussed here in detail.

Figure 2C:
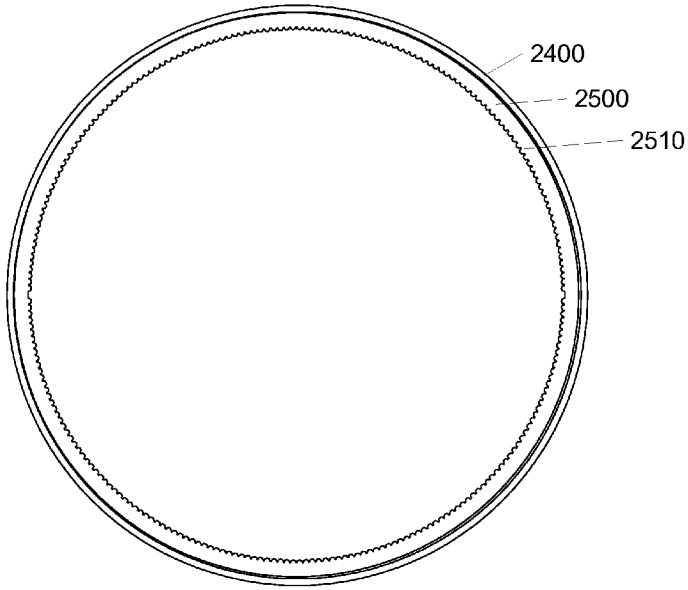
FIG. 2C depicts a cross sectional view of an example embodiment of a cone shaped light reflector having a reflection film and a lenticular optical film with a structured surface of the lenticular optical film facing the inside portion of the light reflector.
Figure 2D:
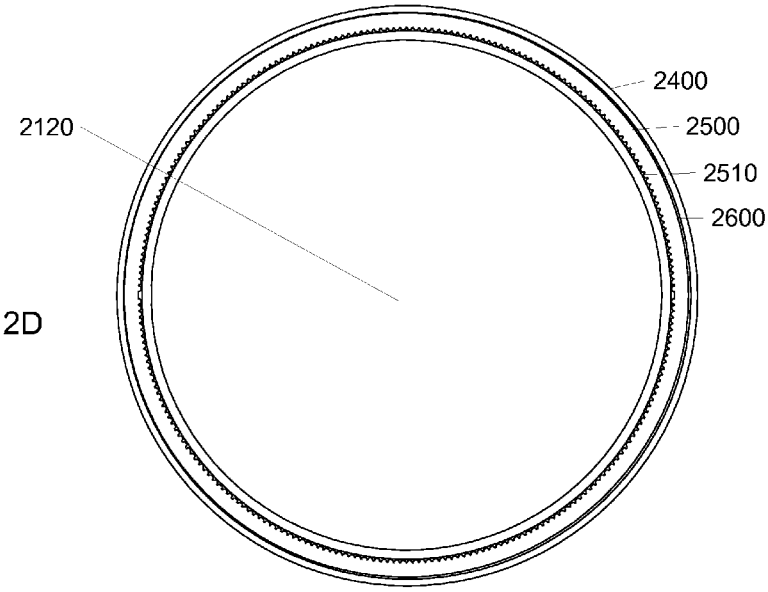
FIG. 2D depicts a cross sectional view of an example embodiment of a cone shaped light reflector having a reflection film, a lenticular optical film, and a diffusion film.
Figure 13A:
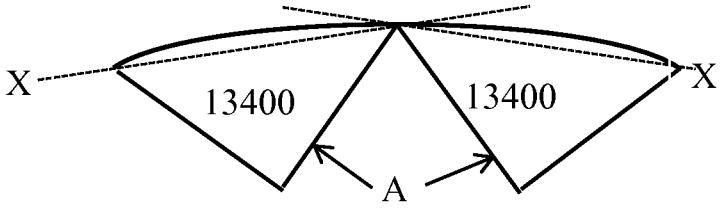
FIG. 13A depicts a cross-sectional non-scale representation of two adjacent prism rows on a curved prismatic optical film wherein the prism rows are aligned vertically.
Figure 13B:
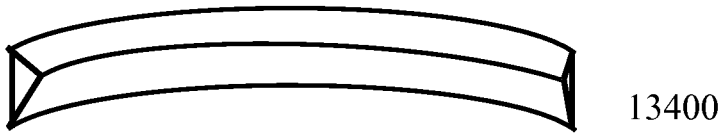
FIG. 13B depicts a cross-sectional non-scale representation of a prism row on a curved prismatic optical film wherein the prism rows are aligned horizontally.

When prism film and a rear reflection surface as previously described are formed into a cone and a light source is disposed inside the cone, analysis of the propagation of reflected and refracted light within the cone may become exponentially more complex when compared to a flat surface. Factors which may cause this increased complexity may be understood with respect to the following:

a) FIG. 13A represents a not-to-scale drawing of two prism rows 13400 of a prism film configured into a cone shape, that are relatively vertical, and with the structured surface facing the inside of the cone. The axis of the base of each prism row, as shown by line X, may not be parallel to each other, such that the angle A may be less than 90 degrees.
b) FIG. 13B depicts the situation when the prism row 13400 (only a single prism row is shown here for clarity) is aligned relatively horizontally, with the structured surface facing the inside of the cone, each prism row 13400 may form a circular shape.
c) FIG. 2F, depicts a prism film which has been cut to an appropriate size and shape to form an example reflector cone. The lines with arrows represent the alignment of the prism rows, which are parallel to each other. FIG. 2G depicts a side view of the resultant cone 2920 that may be formed when the two flat edges of the prismatic film from FIG. 2F are joined along the flat edges 2910. FIG. 2H depicts the view of the opposite side of the cone 2920 that may be formed when the two flat edges of the prismatic film from FIG. 2F are joined along the flat edges 2910. The resultant alignment of the prism feature rows may be represented by the lines on both FIG. 2G and FIG. 2H. For example, on the side of the cone shown in FIG. 2H, the prism row alignment in the middle section of the cone is substantially vertical, and as the rows continue along the circumference of the bottom cone aperture, their alignments diverges towards the horizontal. On the opposite side of the cone as shown in FIG. 2G, the rows diverge further towards the horizontal. Accordingly, it can be observed that the alignment of the prism rows throughout the inner surface of the cone may be continually changing.

d) Due to the nature of the cone shape, the circumference of the prism film decreases as the position in the cone varies from the larger opening towards the smaller opening.

e) The light source inside the cone may represent a large volume relative to the total volume inside the cone, and may comprise a significant relative surface area. When the light source is a self-ballasted spiral CFL for example, the surface area of the spiral tube is significant, and the shape is complex. Accordingly, interference by the surface of the CFL with respect to light ray propagation within the cone may be significant and complex. The light distribution pattern from the tube's irregular surface may also be highly complex.

f) A wide range of shape and sizes of possible light sources may be utilized, and each different light source may have its own unique set of interference and light distribution characteristics.

g) The position of the light source within the cone, which may vary greatly, may have a significant influence on light ray propagation within the cone.

As described above, there are wide ranges of complex parameters that deviate from that of a flat surface that can influence light ray propagation within the cone. Determining or modeling this light ray propagation using methods such as ray trace analysis software, may be impractical from a time and cost standpoint. As such, it may be non-obvious for someone skilled in the arts to factor together all the previously described complex variables, and determine that a light reflector with new and unexpected results with significantly advantageous properties would result from the design elements and description of example embodiments described herein. However, experimental data shows that example embodiments of the disclosed reflectors have significantly advantageous light reflecting properties including, but not limited to, increased brightness and efficiency over traditional reflectors. Additionally, prismatic optical film may have been commercially available since the late 1980's, and despite its widespread use and knowledge of the advantages and principles thereof, its use similar to those as described herein has not been obvious yet to anyone skilled in the art.

Despite the complexities as discussed, some generalizations may be made as to the overall effect the lenticular optical film may have on the propagation of light within the example embodiments of light reflector, which may serve to explain some of the advantageous light reflecting properties of example embodiments of the disclosed technology.

When using lenticular optical film with triangular prism rows for example, generally speaking, off axis light incident on the structured surface of the film may be reflected in a direction more toward the normal of the axis of the structured surface of the prismatic film. Direct on-axis light, incident on the structured surface of the film at a normal angle with respect to the plane of the film surface, may be reflected in a direction perpendicular to the plane of the film surface. Some of the light incident on the structured surface of the prismatic film may refract into the film, and subsequently be totally internally reflected by the rear reflection surface, or otherwise reflected or refracted after striking surfaces within the prism film. Eventually, the light may ultimately exit the structured surface of the prism film, and a significant proportion may be in a direction more towards the normal of the axis of the structured surface. By virtue of the cone reflector surface normal angle generally being aimed towards the large opening (for example, see FIGS. 2B-2 2520), the net effect may be that more light may exit the large opening 2520 when compared a cone reflector with only the rear reflection surface 2400 (as in FIGS. 2B-1) and without the lenticular film 2500.

A reflection surface such as a white painted surface may be characterized as having an overall reflective efficiency of 85% for example purposes. With an 85% reflective efficiency, each occurrence of a light ray striking the reflection surface may cause an approximate 15% light loss due to absorption and other factors. Subsequent multiple reflections, each with an additional 15% light loss, may cause a significant decrease in overall efficiency of the reflector. If the overall reflection efficiency of the reflection surface could be increased, and if the number of multiple reflections within the reflector could be decreased, as may the case with reflection surfaces in example embodiments, a significant increase in overall reflector efficiency may be realized.

According to example embodiments, the orientation and alignment of the prism rows and the cone dimensions may be utilized to control certain light output characteristics of the reflector. According to an example implementation, the orientation of the prism film may be adjusted before cutting the lenticular film to provide a general relative alignment of the prism feature rows. Due to the complex variables introduced into example embodiments of cone shaped light reflector due to lamp configuration, size and placement, determining the optimal configuration of the cone dimensions and configuration of the reflection surface for a given application may best be achieved through testing and experimentation. However, some general cone dimension and reflection surface configurations may generally affect light distribution tendencies of example embodiments of cone reflector.

Figure 14A:
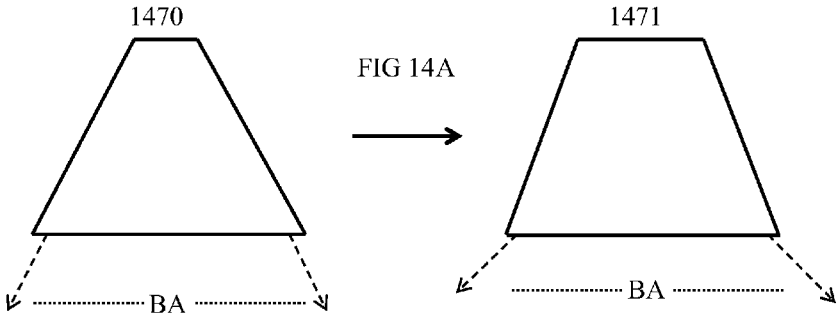
FIG. 14A is a diagram depicting the effect that the changing of the cone shape of example embodiments of light reflector may have on resultant output light distribution.

Referring to FIG. 14A, the reflector on the left 1470, which may have any of the optical film configurations described herein, such as the prismatic film's structured surface facing the inside of the cone or facing the reflection surface, and/or the prism rows aligned horizontally or vertically. BA represents the beam angle of light exiting the reflector. The reflector on the right 1471 represents the same reflector, with the exception that the cone walls are more vertically oriented. As shown, the beam angle may be wider.

Figure 14B:
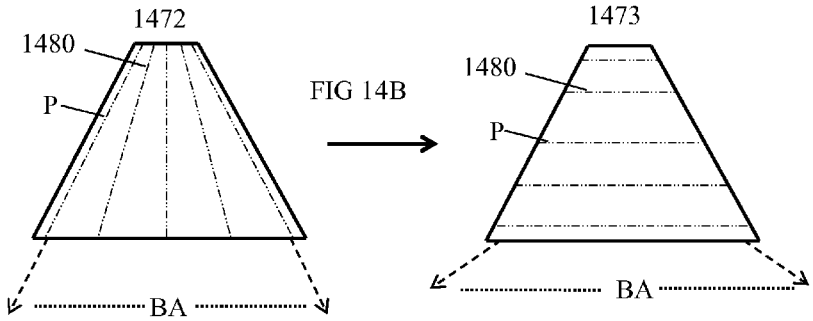
FIG. 14B is a diagram depicting the effect that the changing of the direction of orientation of prism rows of a lenticular optical film in example embodiments of light reflector may have on resultant output light distribution.

Referring to FIG. 14B, the reflector on the left 1472, which may have prismatic film with the structured surface facing the inside of the cone or facing the reflection surface, and has the prism row features 1480 that are aligned relatively vertical. BA represents the beam angle of light exiting the reflector. The reflector on the right 1473 represents the same reflector as 1472 with the exception that the prism rows 1480 are aligned horizontally. As shown, the beam angle may be wider.

Figure 14C:
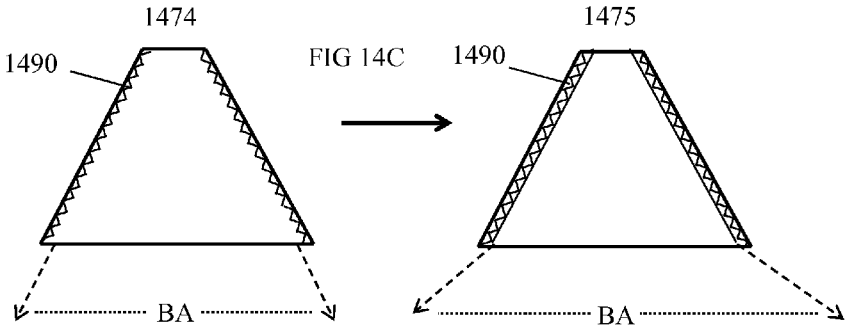
FIG. 14C is a diagram depicting the effect that the changing of the orientation of the structured surface of a lenticular optical film in example embodiments of light reflector may have on resultant output light distribution.

Referring to FIG. 14C, the reflector on the left 1474 has the prismatic film with the structured surface 1490 facing the inside of the cone. BA represents the beam angle of light exiting the reflector. The reflector on the right 1475 represents the same reflector as 1474, with the exception that the structured surface 1490 of the prism film is facing the rear reflection surface. As shown, the beam angle may be wider.

Through experimental testing with various alignments of prism rows, it has been found that the alignment as shown in FIG. 2F, which results in a generally vertical direction of the prism feature rows, may result in the highest efficiency and brightness from example embodiments.

Referring to FIGS. 2B-1, in an example embodiment, a reflective optical film (2400) and lenticular optical film (2500) together may form a hollow cone-shaped light reflector, with or without a support structure. According to an example embodiment, the rear reflection film (2400) may include any high efficiency reflection film, such as a foamed microcellular PET plastic sheet, such as the Ref White series by Kimoto Tech, or specular reflection films such as ESR reflection film by 3M. Reflections films of these types may have very high overall reflectivity of over 97%, and may function to increase the reflection efficiency of the light reflector. The rear reflection film (2400) may also include a cone that is thermoformed from a suitable reflection material, such as a MCPET, a foamed microcellular PET plastic made by Furukawa Electric. A thermoformed cone may have the advantage of being able to function as a light reflection layer, and be rigid enough to function as a support structure for embodiments of light reflector that will subsequently be described. This may eliminate the need for requiring a separate support structure in certain applications, which may result in cost savings. In addition, there may be no visible seam line in the rear reflection film (2400), which may be visually preferable in some applications.

Some computer software programs may allow the dimensions of the required cone to be entered, and a cutting template may be subsequently generated. FIG. 2F depicts such an example of a generated cutting template. The generated template data may be used to control computer controlled cutting machines such as film cutting plotters manufactured by Graphtec America, which may efficiently and cost effectively cut the reflector cone pieces from rolls of optical film. The optical films in any example embodiments of the disclosed technology may be configured in this manner or any other suitable methods. Additionally, cutting plotters may also create score lines onto the optical film's surface. (score lines will be discussed in other example embodiments).

Figure 4:
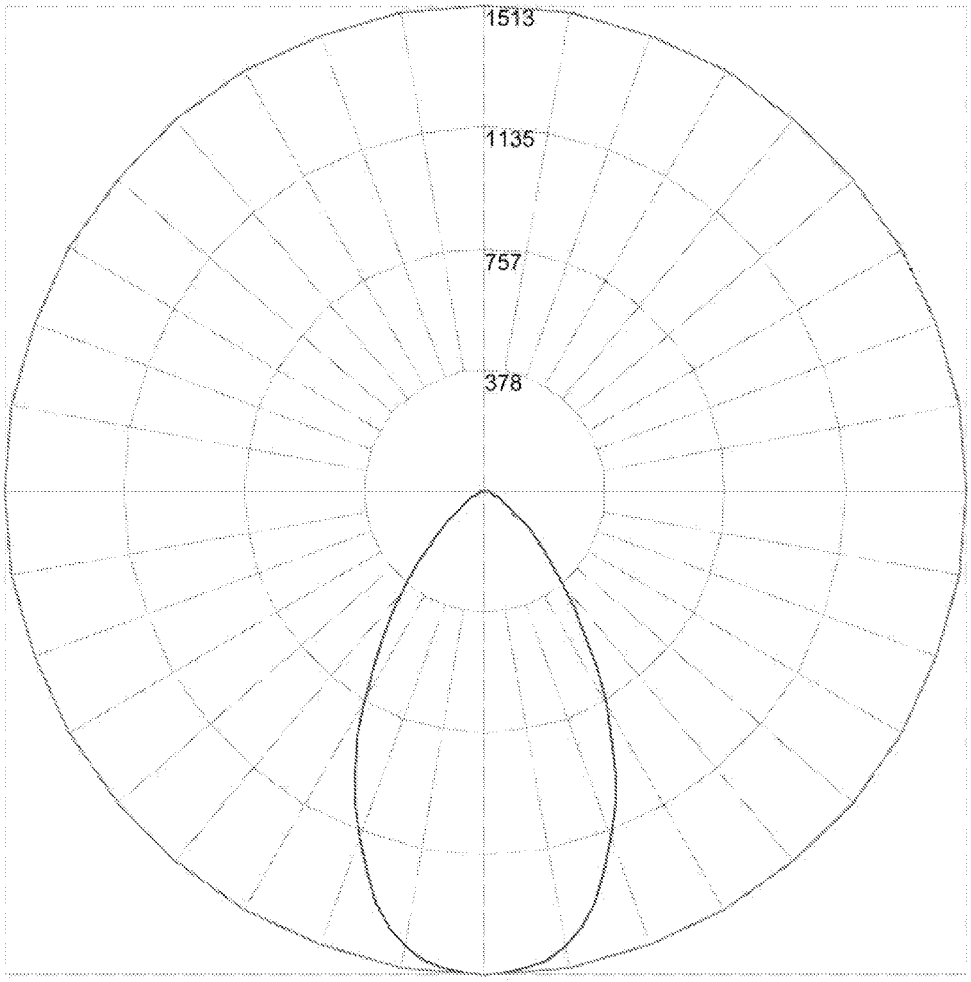
FIG. 4 shows a polar candela chart of an example embodiment of light reflector compared to a commercially available cone reflector of a similar shape.

FIG. 4 shows a polar graph of a photometric test report conducted on an example embodiment of light reflector, and FIG. 5A and FIG. 5B shows various other test data from the same test. The reflector was configured with a rear reflection film and a prismatic film, and sized to retrofit inside of a commercially available 6" reflector cone designed for use with a 26 watt TTT CFL. The commercially available reflector was used only as a method to mount the example embodiment of reflector into the light fixture for testing, and the example embodiment of light fixture almost completely covered the inside of the commercially available reflector. The prism film was configured with the structured surface facing the inner cone portion, and the prism rows were aligned relatively vertical.

As shown by the test data in FIG. 5A, the total luminaire efficiency was 91%. Typical higher end commercially available fixtures designed for the same CFL may have approximate average efficiencies in the range of 65% to 78%, with the highest published efficiency found by the Applicant being 84%. Embodiments of the disclosed technology represent a significant increase in the total luminaire efficiency. The spacing criterion indicates 0.92, which is relatively narrow when compared to typical fixtures with CFLs that may have much wider beam angles that may give spacing criterion of approximately 1.3 to approximately 2. FIG. 5B shows the experimentally obtained Candela distribution data of an example embodiment. The maximum brightness is 1513 candelas, which represents an approximate 100% increase compared to the previously mentioned commercially available light fixture with the highest published efficiency.

According to certain example implementation of the disclosed technology, the orientation of the prism row features may be chosen based on the requirements of the intended application. For example, if the prism rows are aligned similar to that shown in FIG. 2F when flat, then the resultant prism row alignment when formed into the cone shape may be relatively vertical. This alignment may give a more narrow light distribution for the reflector. In an example implementation, if the prism rows are aligned similar to that shown in FIGS. 2F-2 when flat, then the resultant prism row alignment when formed into the cone shape may be relatively horizontal. This alignment may give a wider light distribution for the reflector.

In all subsequent example embodiments, the alignment of prism row features may be configured relatively horizontal or relatively vertical as discussed, and for brevity, will not be repeated.

The orientation of the structured surface of the lenticular optical film, according to certain example implementations, may be oriented to face the inner cone portion or the outer cone portion. Referring to FIGS. 2B-1, rear reflection surface 2400, and lenticular optical film 2500 together may form a cone-shaped light reflector. FIG. 2C shows a cross sectional plan view (not to scale) of an embodiment of light reflector shown in FIGS. 2B-1. Prism film 2500 nests on top of reflection film 2400, with the structured surface 2510 of prism film 2500 facing the inner cone portion. This configuration may result in a narrower light distribution pattern exiting the reflector.

Figure 2E:
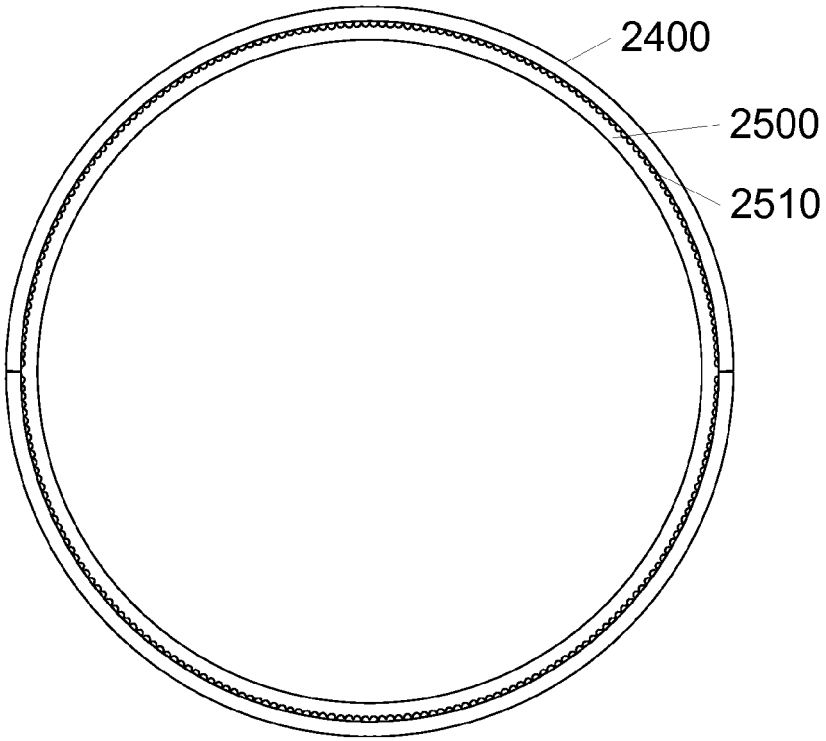
FIG. 2E depicts a cross sectional view of an example embodiment of a cone shaped light reflector having a rear reflection film and a lenticular optical film with the structured surface of the lenticular optical film facing the rear reflection film.
Figure 2F:
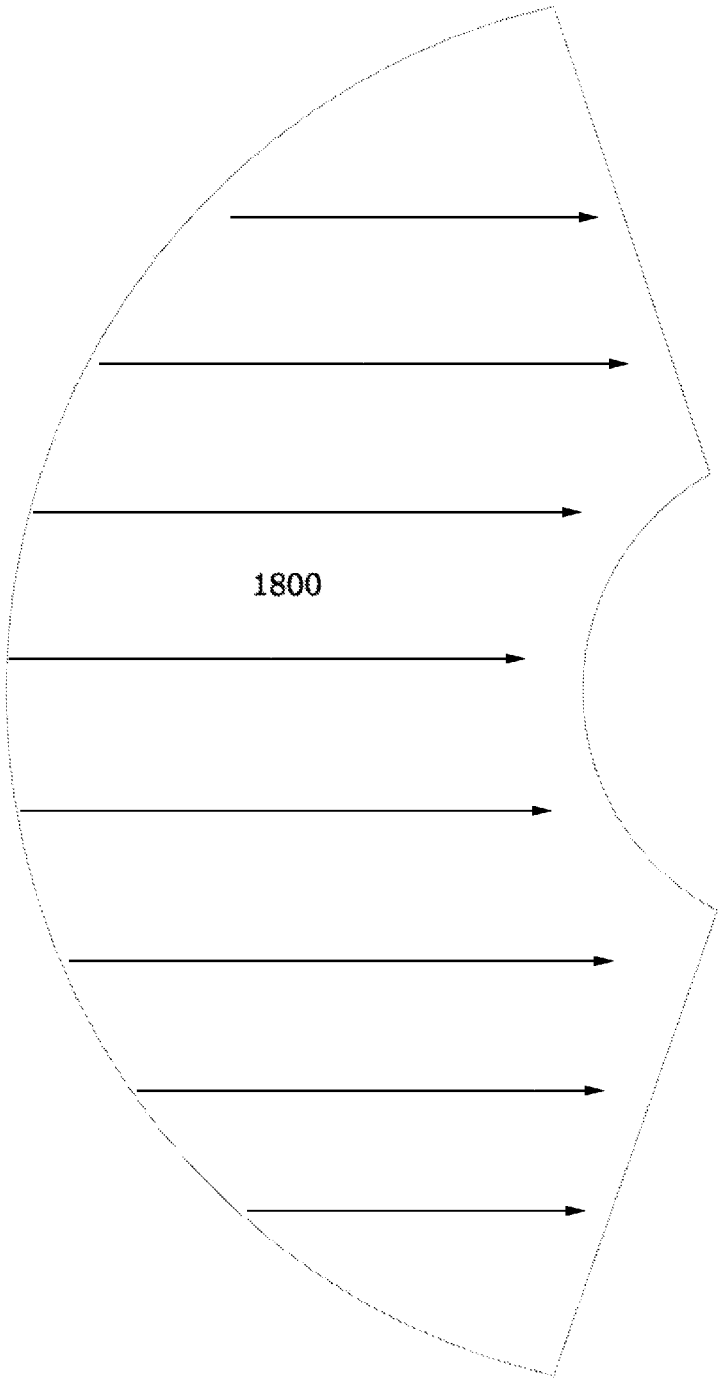
FIG. 2F depicts an example optical film cutting template or an example cut piece of prismatic optical film with arrows indicating the alignment of the prism feature rows, which may result in a prism row alignment that forms a minimum angle with respect to the optical axis of the fixture when formed into a cone shape.
Figures 2, 2F:
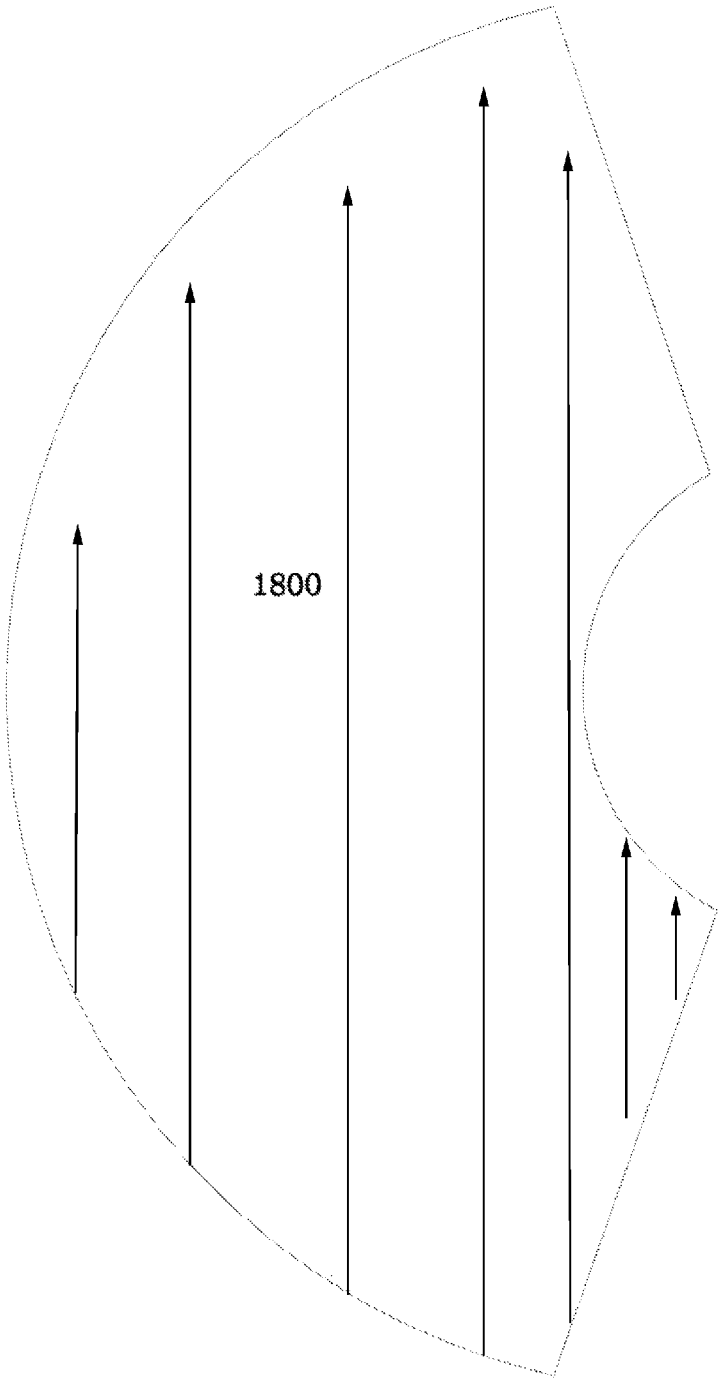
Figure 2G:
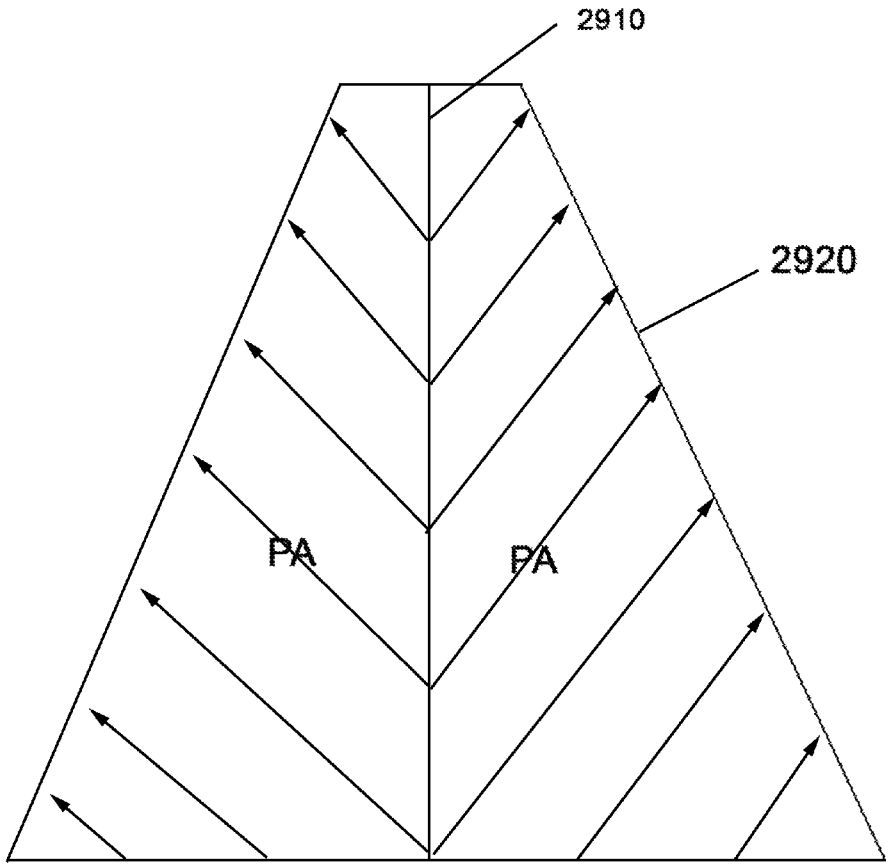
FIG. 2G depicts an example side view of a cut piece of prismatic optical film formed into a cone, with lines indicating an alignment of the prism feature rows.
Figure 2H:
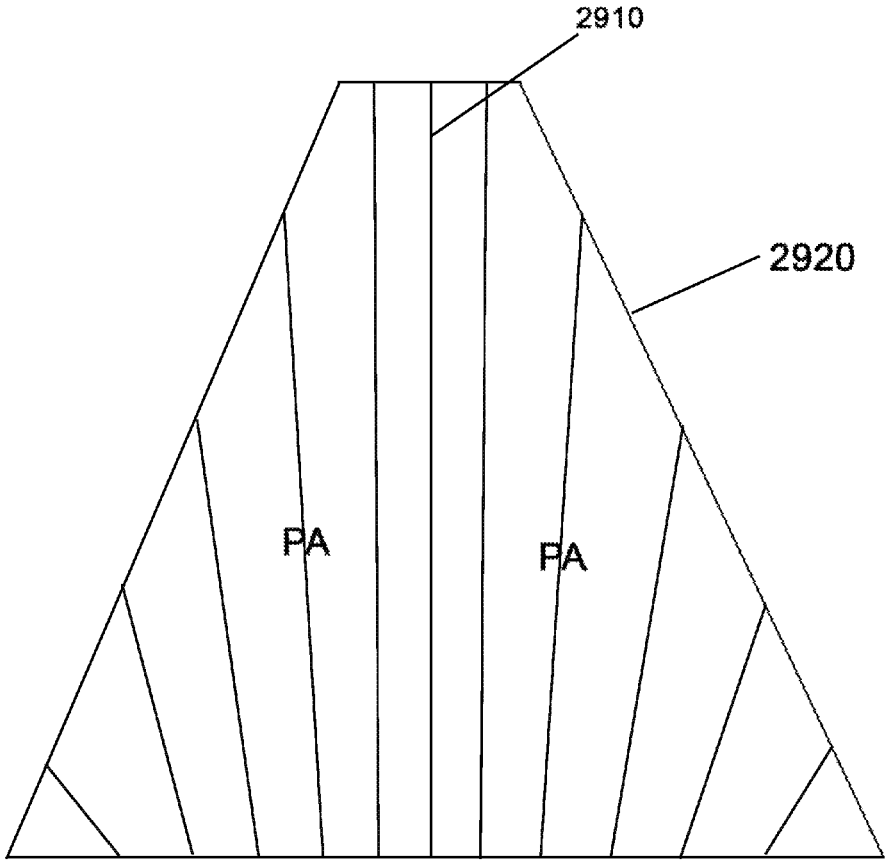
FIG. 2H depicts an example side view of the opposite side of a cut piece of prismatic optical film formed into a cone as shown in FIG. 2G, with lines indicating an alignment of the prism feature rows.

FIG. 2E, depicts a cross sectional view of an example embodiment (not to scale), wherein the structured surface 2510 of prism film 2500 faces the rear reflection film 2400. This example embodiment may have the advantage that the structured surface of the lenticular optical film 2510 is facing the reflection surface 2400, which may protect the structured surface from damage, abrasions, dust, etc. The exposed smooth surface of the lenticular optical film may be more durable and easier to clean. The beam angle of light output from the example embodiment of the reflector may be significantly broadened as previously described, which may be advantageous in certain lighting applications.

In all subsequent example embodiments, the orientation of the structured surface of the lenticular optical film may be configured facing the inner cone portion, or the outer cone portion as discussed, and for brevity, will not be repeated.

Other example embodiments of the disclosed technology will now be described. It should be noted however, that elements, principles, configurations, test data, advantages, specifications, fabrication, etc., of the example embodiments of the disclosed technology that have previously been described may be applicable to subsequent example embodiments of the disclosed technology, and may not be repeated in subsequent example embodiments of the disclosed technology for brevity. These elements, principles, configurations, test data, advantages, specifications, fabrication. etc. may be deemed included in subsequent example embodiments of the disclosed technology unless otherwise described or noted.

An example embodiment of light reflector will now be described. This example embodiment may be similar to the example embodiment depicted in FIGS. 2B-1 (and previously described) except for the addition of an optical diffusion film. Referring to FIG. 2A, the rear reflection surface 2400, the lenticular optical film 2500 with structured surface 2525 facing the inner cone portion, and the top diffusion film 2600 together may form a cone shaped light reflector. Referring to FIG. 2D, and according to the example embodiment, a diffusion film 2600 may be attached or disposed adjacent to the lenticular optical film 2500 with its structured surface 2510 facing the light source.

According to an example embodiment, the diffusion film (for example, film 2600 as shown in FIG. 2A) may comprise many types of diffusion films, for example, diffusion films such as those commonly used in backlight assemblies for televisions that have a high efficiency of light transmission. The haze rating of the diffusion film may affect the light distribution pattern. Generally, the higher the haze rating, the broader the light dispersion pattern from the reflector may be, and the lower the efficiency may be. For example, on a compact fluorescent lamp, a haze rating of 50% may broaden the beam angle by about 5% compared to no top diffusion film, and a diffusion film with a haze rating of 88% may broaden the beam angle by about 10%. Accordingly, the haze rating of the diffusion film may be tailored to somewhat broaden light distribution requirements of the reflector. FIG. 2D shows a cross sectional view of an example embodiment of reflector cone (not to scale), which includes the rear reflector 2400, the lenticular optical film 2500 with structured surface 2510 facing the inner portion of the cone 2120, and top diffusion film 2600 with structured surface facing the inner portion of the cone 2120.

In an example embodiment of the light reflector, as shown in FIG. 2D and described above may have the advantage of having a somewhat increased beam angle, which may be advantageous for applications requiring a broader light distribution pattern. The diffusion film 2600 may also serve to protect the delicate structured surface of the lenticular optical film 2510 from scratches, dust and abrasions. Some diffusion films may allow for periodic cleaning without being damaged. More importantly, the diffusion film may function to give a more pleasing visual appearance to the reflector, especially when the lamp is off. The diffusion film may impart a "pearlescent" look that may be less specular and more visually pleasing. The aesthetics of reflectors, both with the lamps on and off may be of significant importance, especially in higher end commercial applications. Due to the increased light scatter caused by the diffusion film 2600, decreased efficiency of the example embodiment of light reflector may occur due to increased multiple reflections with the reflector, causing light absorption losses. However, diffusion films can be utilized with very low haze ratings, according to certain example embodiment of the disclosed technology, which may minimize this efficiency loss.

An example embodiment of light fixture or light fixture reflector will now be described. FIG. 1A shows an exploded perspective view of a typical recessed downlight fixture fitted with an example embodiment of light fixture reflector. In an example implementation, a fixture enclosure 1000 along with lamp socket 1150 and lamp socket base 1100 may represent a simplified typical recessed downlight luminaire enclosure, sometimes referred to a "can" light" or "pot" light. According to an example implementation, these light fixtures may have a reflector that attaches inside the fixture enclosure 1000 to modify light from the light source, and help direct light out of the fixture. In an example implementation, the reflector may be held in the fixture with extension springs, torsion springs, or clips. It should be noted that the various methods of attachment of the example embodiments into an enclosure will not be described or depicted, and it should be assumed by the reader that the method of attachment would utilize one of the above listed methods unless otherwise noted. The example embodiment may represent a light fixture reflector retrofit to replace an existing reflector in a downlight enclosure, or it may represent a light fixture reflector for use in newly manufactured downlight enclosures, or may be utilized as a standalone light fixture.

The optical film arrangements, orientations, etc. of the example embodiment of light reflector shown in FIG. 2A thru 2E and described previously, may be utilized in this light fixture reflector or light fixture example embodiment, and will not be repeated here. It should be noted that for reasons of simplification, the drawings and descriptions of the example embodiment refer to a rear reflection film, a top lenticular optical film and a top diffusion film. Some example embodiments of light reflector shown in FIG. 2A thru 2E and described previously, do not include or require a top diffusion film. Some example embodiments of light reflector do not include or require a bottom reflection optical film. Accordingly, these configurations should be deemed as included in this and other example embodiments described herein.

Again referring to FIG. 1A, this example embodiment may include a rear reflection surface 1400 a lenticular optical film 1500 and an optional diffusion film 1600. The rear reflection surface 1400 may alternatively be the inner surface of the reflector cone 1200, without utilizing a reflection film as described in other embodiments. The reflector cone 1200 may include a film-mounting channel 1300 (and will be explained further with reference to FIGS. 1B-1 below). The inside surface of the reflector cone 1200 may have a high efficiency reflection material disposed on its surface, such as high reflectivity paint, or metal coatings, etc. According to an example embodiment, all the optical films may be disposed directly in contact with adjacent layers, and may nest in reflector cone 1200. According to an example embodiment, the reflector cone 1200 may be comprised of metal. According to an example embodiment, the reflector cone 1200 may be comprised of plastic. According to an example embodiment, the reflector cone 1200 may include the appropriate mounting brackets, holes, springs and trim rings as required (not shown) to attach to the fixture enclosure 1000.

Referring now to FIGS. 1B-1, the reflector cone 1200 may include a film-mounting channel 1300 along the circumference of the large opening, and may include an optional film-mounting channel 1310 along the circumference of the smaller opening. The film mounting channels 1300 and 1310 may comprise an "L", "V" shape or any other shape that may function to secure the optical films efficiently to the reflector cone 1200. The optical films may be configured as previously described. The film layers may be manually coiled to the approximate final shape, and inserted into the reflector cone 1200 such that the bottom edges are disposed inside the film mounting channel 1300 and optionally, the top film channel 1310. When released, and according to an example embodiment, the film may lay flat against the surface area of the inside of the reflector cone 1200. Since the optical films may naturally lie flat, when they are coiled, they may retain some spring or torsional force until they are once again in a flat state. This spring or torsional force and the mounting ridges 1300 and 1310 may function to keep the optical films securely mounted and flat inside the reflector cone 1200, according to certain example embodiments of the disclosed technology. Film mounting channel 1300 is also depicted in FIG. 1A along the bottom edge of reflector cone 1200.

FIGS. 1B-2 depicts a close up view of the bottom edge of the reflector cone, with optical films 1400, 1500 mounted as described above. The optical films may be sized such that they may overlap each other when mounted in the reflector cone, or they may be sized such that the film edges meet. In certain embodiments, it may be preferable for the lenticular film to not overlap, and to have the edges butt together, as any overlapping portions may be clearly visible and may not be visually acceptable in some applications. At least one advantage of the optical films being secured to the reflector cone 1200 as described may be that adhesives applied to the lenticular optical film on either side will be clearly visible and may not have an acceptable appearance, and may degrade the optical performance of the reflector.

Figure 1C:
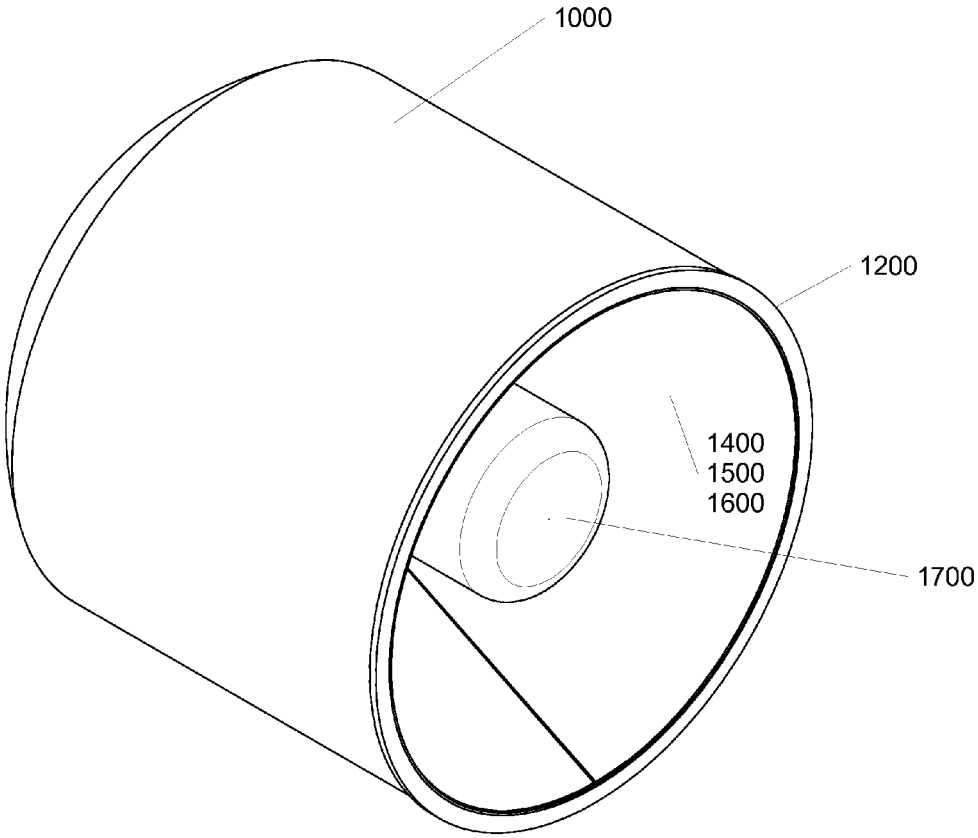
FIG. 1C depicts a perspective assembled view of the light fixture with reflector cone of the example embodiment as depicted in FIG. 1A.

Referring again to FIG. 1A, the reflector cone 1200 along with mounted optical films 1400, 1500, 1600 may be inserted and attached into fixture enclosure 1000, and secured with the appropriate springs and trim ring (not shown). A lamp or light source, such as a CFL lamp 1700 for example, may then be inserted into the fixture and screwed into lamp socket 1150. An assembled downlight with example embodiment of retrofit apparatus is shown in FIG. 1C. As shown in FIG. 1C, the reflector assembly, which includes reflector cone 1200 along with reflection film 1400, lenticular film 1500, and diffuser film 1600, according to an example embodiment, may be disposed approximately flush with the aperture of the fixture enclosure 1000, and light from the light source 1700 may predominately interact only with the reflector surface 1400, lenticular film 1500, and/or diffuser 1600, for example, and may minimally interact with any part of the light fixture enclosure. Accordingly, the performance, properties, advantages etc. of the example embodiment of light fixture or light fixture reflector may be substantially the same to those previously described in example embodiments of light reflector, and will not be repeated here or other similar example embodiments.

Figure 3A:
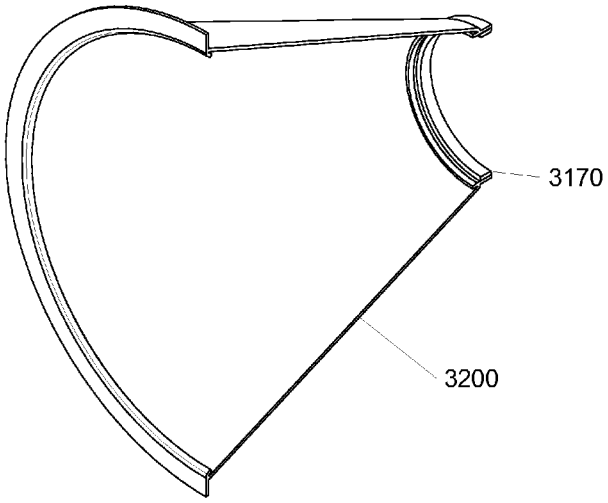
FIG. 3A shows a cutaway perspective view of an example embodiment of a light reflector.
Figure 3B:
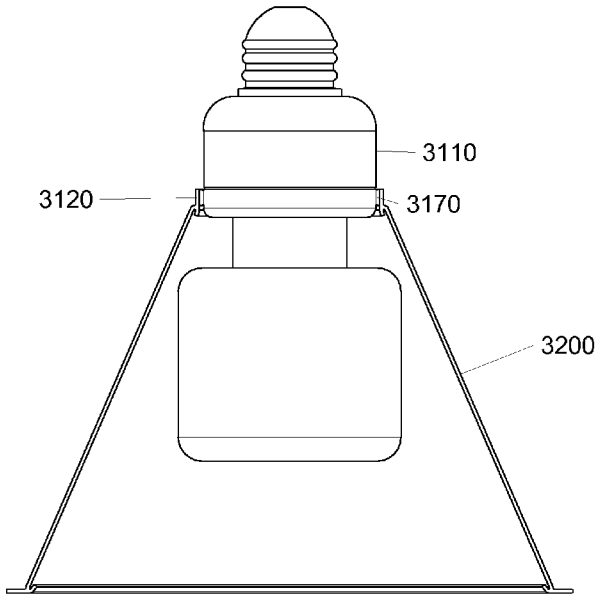
FIG. 3B shows a cutaway side view of an example embodiment of a light reflector.

FIG. 3A depicts a perspective cutaway view, and FIG. 3B depicts a cross sectional cutaway view of the example embodiment of light fixture reflector as shown in FIG. 1A, except that a gasket 3170 on the inside of the reflector cone 3200 as shown, may form a substantially air tight seal around the CFL integral ballast 3110. Air from inside the reflector may be substantially prevented from escaping into the light fixture enclosure. This may prevent heated or cooled air from a room where the light fixture is disposed from escaping through the light fixture enclosure into the ceiling above. In an example implementation, a small collar 3120 around the top opening of the reflector cone 3200 may be added to allow extra mounting room for the gasket 3170, and to make a larger contact area with the CFL integral ballast 3110. The optical film configurations may be the same as described in other example embodiment, but are not shown or further described here.

Standard spiral CFLs with integral ballast may be the most common and cost effective types of all CFLs to utilize with example embodiments of the disclosed technology. For example, they have the advantage of having a medium E26 base (standard Edison screw base), which may enable them to be used in many incandescent light fixtures. When traditional recessed downlights utilizing traditional incandescent reflectors are fitted with standard spiral CFLs, optical performance may be significantly decreased due to the CFL's light distribution pattern, complex lamp geometry and lamp positioning, resulting in a significant loss of maximum brightness, luminaire efficiency and an uneven light distribution pattern. Spiral CFLs may be available as "reflector" style lamps, which may be configured to similar incandescent lamp formats such as Par 38, BR-30, etc. These lamps typically may be spiral type CFLs that have a glass enclosure surrounding them, which may include a reflective coating around the rear section of the glass enclosure. This rear reflector may function to direct a significant amount of light forward, and out of the downlight fixture, thus increasing the recessed downlight reflector's efficiency. Typically, however, reflector style CFLs have a decreased efficacy of over 20% compared to non-reflector style CFLs, which may, in effect, negate a significant portion of the increased reflector efficiency as described. Another drawback is that reflector style CFLs does little to condense the beam angle. While incandescent lamps may be available in a multitude of configurations of beam spreads, from "narrow spot" to "extra wide flood", reflector style CFLs may typically be available only in very wide beam angles. Reflector CFLs may also be significantly more expensive than spiral CFLs.

A long felt need exists for a lamp reflector or a lamp retrofit apparatus that may attach to a standard spiral CFL lamp that has some or all of the following advantages: (a) a higher efficacy than "reflector" style CFLs; (b) the ability to significantly condense the very wide beam angle with low light loss due to absorption; (c) the ability to increase optical performance without the time and expense of having to replace the recessed downlight reflector; (d) the ability to emulate the sizes of various incandescent reflector lamps, allowing them to be used in existing incandescent recessed downlight reflectors; (e) a clip-on retrofit which enables a standard spiral CFL to have the advantages of a) through d), while enabling the use of the existing downlight reflector, which may save the time and expense of the installation of a new reflector.

Figure 7A:
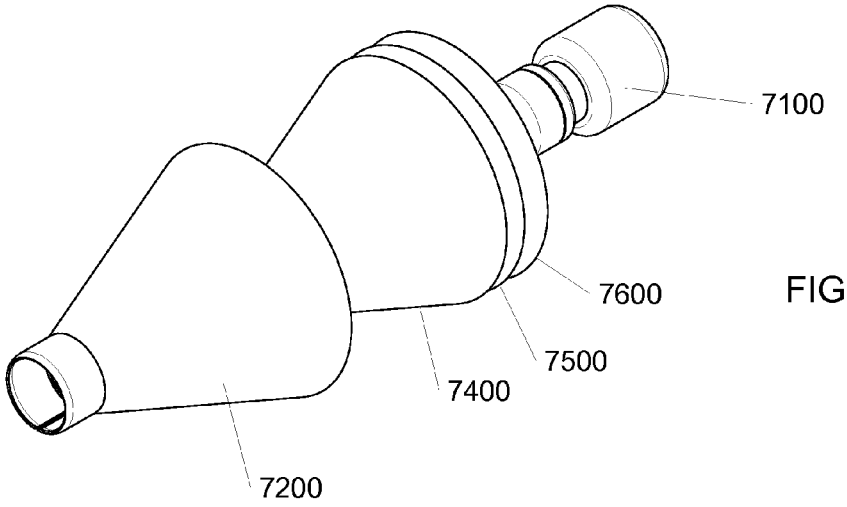
FIG. 7A depicts an exploded perspective view of an example embodiment of lamp reflector or lamp retrofit apparatus.
Figure 7B:
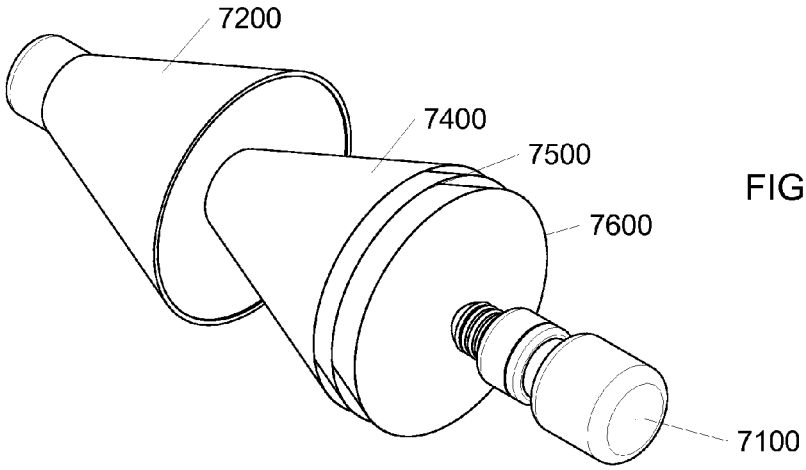
FIG. 7B depicts another exploded perspective view of an example embodiment of lamp reflector or lamp retrofit apparatus.
Figure 7C:
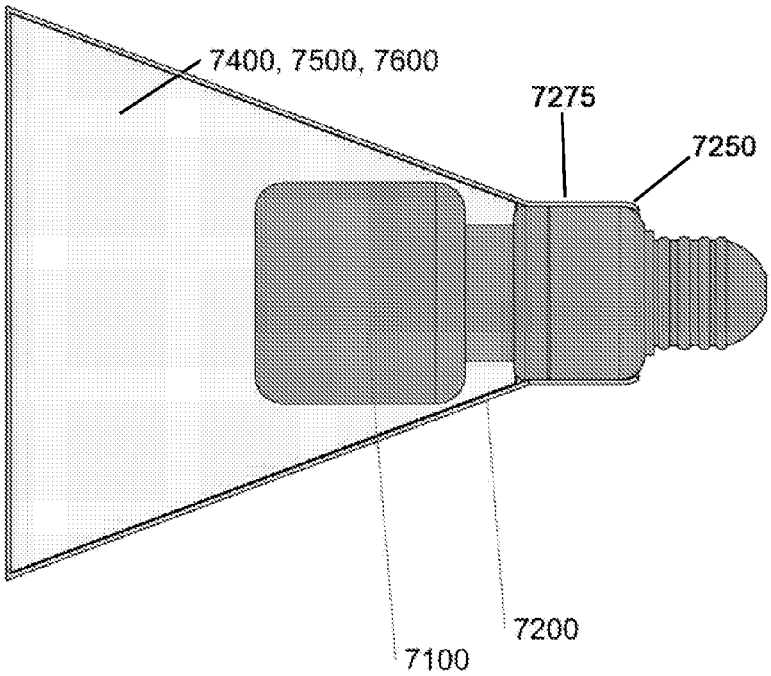
FIG. 7C depicts a cutaway cross sectional view of the example embodiment of lamp reflector or lamp retrofit apparatus depicted in FIGS. 7A and 7B.

An example lamp retrofit apparatus or lamp reflector embodiment will now be described. FIG. 7A and FIG. 7B shows an exploded perspective view of an example embodiment. FIG. 7C shows a side view cutaway of an example embodiment. In FIG. 7A and FIG. 7B, optical films 7400, 7500, 7600 may nest inside a reflector cone 7200. The optical films 7400, 7500, 7600 may be disposed and attached to the inside of the reflector cone 7200 in the same manner as other example embodiments previously discussed. Referring to FIG. 7C, a CFL lamp 7100 may be inserted into the reflector cone 7200 until the curved ends of the reflector cone 7250 grasp the edges of the CFL lamp 7100 as shown. Spring tension from the reflector cone base 7275 and the curved ends 7250 may function to keep the reflector cone 7200 firmly attached to and aligned with the lamp 7100. In an example implementation, the reflector cone 7200 may be comprised of metal. In another example implementation, the reflector cone 7200 may be made of plastics with suitable heat resistance characteristics and strength or rigidity characteristics. In the example embodiment, the reflector cone base 7275 may substantially cover the integral ballast casing of the CFL lamp 7100. Accordingly, if the reflector cone 7200 is fabricated from metal, it may function as a heat sink, which may conduct and disperse heat away from the ballast casing, and improve the CFLs thermal efficiency and ballast life expectancy. If the reflector cone 7200 is comprised of plastic, ventilation openings on the reflector cone base may be necessary, such as ventilation openings 9850 as shown in FIGS. 9C-1.

According to certain example implementations, the dimensions of the reflector cone 7200 may be sized such that the dimensions of the retrofitted CFL may emulate the overall proportions of various incandescent reflector style lamps such as Par38, R-30, R-40 etc. This may enable a direct replacement for incandescent reflector style lamps used with existing, installed incandescent downlight reflectors. Accordingly, the existing reflector may be utilized, and the lamp socket depth may not need to be adjusted. This may save considerable time and expense compared to removing the existing reflector, adjusting the lamp socket depth, and installing a new reflector. The advantages may be considerable when considering a retrofit of a large number of downlight fixtures at a location. Typically, recessed incandescent downlight fixtures may be installed relatively close together on a ceiling, especially if close spacing criterion was utilized for narrower beam angle lamps. This may create a large number of fixtures in any given location. Savings of time, effort and cost, even if modest, may be of significant benefit when multiplied by a large number of fixtures.

Figure 8C:
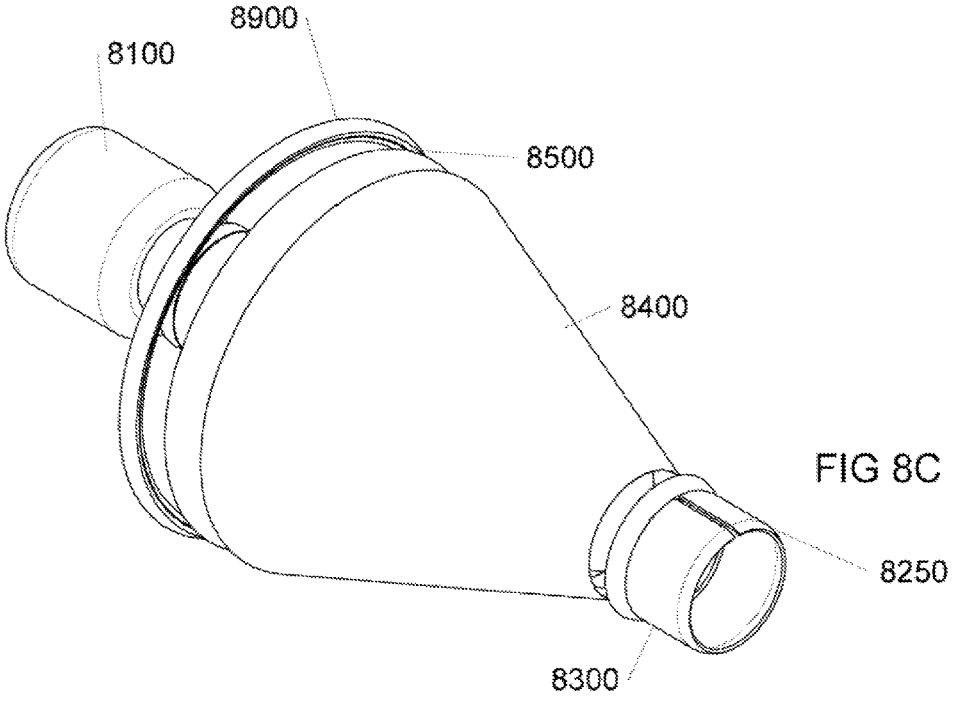
FIG. 8C depicts another perspective exploded view of an example embodiment of lamp reflector or lamp retrofit apparatus with no optical film support structure.

According to an example embodiment, another lamp retrofit apparatus or lamp reflector will be described, which may have all the advantages of the example embodiment of lamp retrofit apparatus or lamp reflector previously described, but may also have the advantage of lower manufacturing costs, and lighter weight. FIG. 8A depicts a perspective view of the example embodiment, and FIGS. 8B and 8C depicts an exploded perspective view of the example embodiment.

Referring to FIGS. 8B and 8C, rear reflection film 8400 and lenticular optical film 8500 may be coiled to their approximate final shape, and the edges of the small opening of the resulting optical film cone may be inserted into the film channel 8310 of the reflector base 8300. An adhesive may be applied inside the film channel 8310 prior to insertion of the optical film cone to secure the optical films inside the film channel 8310. According to an example implementation, the reflection film may be sized such that when inserted into the film channel 8310, the edges overlap, which may function to prevent any gaps between the film edges, as well as creating stronger walls of the optical film cone. In an example implementation, the optical film edges of the larger opening of the cone may be inserted into the film channel on the trim ring 8900, which may function to add a more finished appearance to the example embodiment, and to add greater strength and stability to the optical film cone.

Referring now to FIG. 8C, and according to an example embodiment, a CFL lamp 8100 may be inserted into the assembled lamp retrofit apparatus or lamp reflector until the curved ends of the reflector cone 8250 grasp the edges of the CFL lamp ballast. Spring tension from the reflector base 8300 and the curved ends 8250 may function to keep the example embodiment firmly attached to the lamp 8100. According to an example implementation, the reflector base 8300 may be comprised of metal or plastics with suitable heat resistance characteristics as mentioned previously. In an example implementation, the reflector cone base 8300 may substantially cover the integral ballast casing of the CFL lamp 8100. Accordingly, if the reflector cone is fabricated from metal, it may function as a heat sink, which may conduct and disperse heat away from the ballast casing, and improve the CFLs thermal efficiency. If the reflector base 8300 is comprised of plastic, ventilation openings on the reflector cone base may be necessary, such as ventilation openings 9850 as shown in FIG. 9C.

According to an example embodiment, a lamp retrofit apparatus or lamp reflector will be described, which may have some or all the advantages of example embodiments of lamp retrofit apparatus or lamp reflector previous described, but may also have the advantage of having an optional substantially air tight seal between the reflector and the CFL integral ballast. This may prevent heated or cooled air from the space where the light fixture is disposed from escaping into the light fixture enclosure, and into the ceiling above. It may also have the advantage of being able to accept a standard medium base socket with mounting clips.

FIGS. 9A1, 9A-2, 9B-1, and 9B-2 depict perspective views of an example lamp retrofit apparatus embodiment. FIGS. 9C-1 and FIGS. 9C-2 depict an exploded perspective view of the example retrofit apparatus embodiment. FIG. 9D depicts a cross sectional cutaway view of the example retrofit apparatus embodiment. Referring to FIGS. 9A-1 or FIGS. 9A-2 or FIGS. 9B-1 or FIGS. 9B-2 or FIGS. 9C-1 or FIGS. 9C-2, the reflector cone 9200 may be a single unit, fabricated from a suitable material such as heat resistant plastic or metal. The various configuration of optical films used in this example embodiment may be the same as described in other example embodiment and may be disposed or attached to the inside of the reflector cone 9200 in the same manner as with other example embodiments previously described. According to an example embodiment, the reflector cone 9200 may include mounting ridges 9300, as shown in FIG. 9D, that may form a channel that may secure the optical films to the inside surface of the reflector cone 9200. Referring to FIGS. 9C-1, a standard E26 medium type lamp socket with integral clips 9160 may be inserted into the opening 9180 on the top of the reflector cone 9200 and the clips 9160 on the lamp socket 9150 may attach to the reflector cone top 9200 through clip sockets 9195.

Referring to FIG. 9D, according to certain example embodiments, a standard spiral CFL 9100 may be fully inserted into the reflector cone 9200 and screwed into the lamp socket 9150. The integral ballast 9110 of the CFL 9100 may fit tightly into the neck 9175 of the reflector cone 9200 and the reflector cone 9200 may be sufficiently secured, and symmetrically aligned with the CFL 9100. According to an example embodiment, openings in the reflector cone (for example, as in openings 9850 shown in FIGS. 9C-1) may allow sufficient heat dissipation of the integral ballast 9110 of the CFL 9100.

An optional gasket 9170 on the inside of the reflector cone 9200 as shown, may form a substantially air tight seal around the CFL integral ballast 9110, wherein air from inside the reflector may be substantially prevented from escaping into the light fixture enclosure at a rate of more than 2 cfm. This may prevent heated or cooled air from a room where the light fixture is disposed from escaping through the light fixture enclosure into the ceiling above.

It should be noted that many common methods of creating an "airtight" downlight reflector exist in the lighting industry, and any or all of these methods may be applicable to any or all example embodiments of the disclosed technology.

Figure 6A:
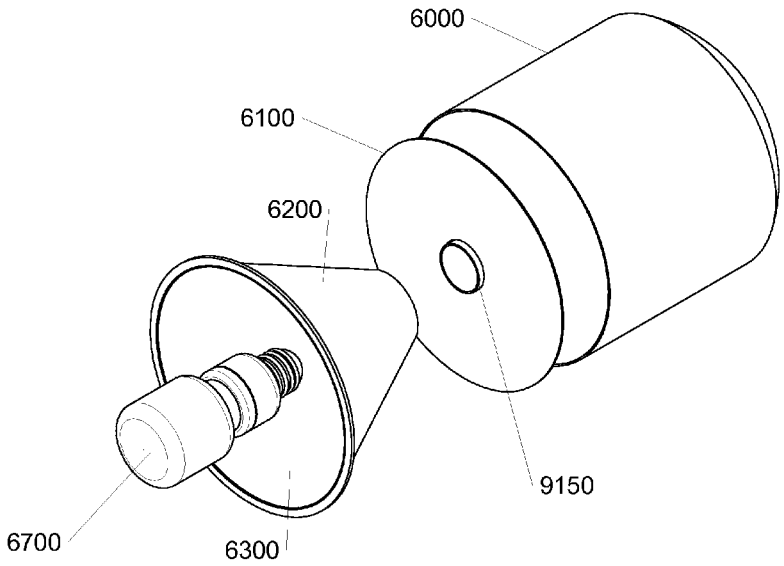
FIG. 6A depicts an exploded perspective view of a light reflector according to an example embodiment of the disclosed technology, suitable for use with a compact fluorescent lamp (CFL) with integral ballast.
Figure 6B:
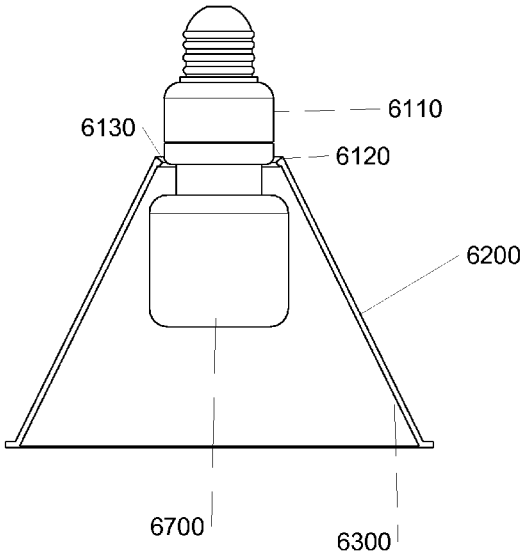
FIG. 6B depicts an cross sectional cutaway view of a light reflector according to an example embodiment of the disclosed technology, suitable for use with a CFL with integral ballast.

According to an example embodiment of the disclosed technology, a light reflector according to another example embodiment will now be described. FIG. 6A and FIG. 6B depicts an example reflector that may be suitable for use with a CFL with integral ballast, in a recessed downlight fixture. The example embodiment of light reflector that will now be described that may have the advantage of higher efficiency with lower light losses within the reflector.

Referring to FIG. 6A and FIG. 6B, when CFLs with integral ballasts are used with reflectors designed for incandescent or linear CFL downlights, the integral ballast 6110 may be physically disposed inside the reflector cone 6200. The integral ballast 6110, when disposed inside a reflector, may absorb light that is incident on its surface, and may disrupt the light distribution and light propagation within the reflector, causing unwanted multiple reflections and further light loss.

According to the example embodiment, the reflector cone 6200 may be inserted into a recessed downlight enclosure 6000 and may attach to the downlight enclosure 6000 in a manner as previous described in other example embodiments. In an example implementation, a CFL 6700 with integral ballast 6100 may be inserted into reflector cone 6200 and screwed into lamp socket 9150 which is mounted on lamp socket base 6100. According to an example implementation, the lamp socket depth in the enclosure may be adjusted so that the boundary where the integral ballast 6110 meets the light emitting surface of the CFL is disposed in close proximity to the top opening of the reflector cone 6120, as shown. An air gap 6130 may allow air from the inside of the reflector cone 6200 to escape, allowing for heat dissipation of the CFL 6700, which may result in higher efficiency output of the CFL 6700.

According to an example implementation, the reflection surface 6300 inside the reflector cone 6200 may be any suitable reflection surface appropriate for the intended application. For example, in one embodiment, the reflection surface

6300 may include a white painted surface. According to another example embodiment, the reflector cone 6200 may include a specular metallic surface. According to other example embodiments, the reflector cone 6200 may include any of the reflection surfaces described previously. Optical film configurations for any or all example reflector or light fixture embodiments described above may also be utilized in this example embodiment.

According to an example implementation, when the integral ballast 6110 of CFL 6700 is disposed outside the reflector cone 6200, the light reflector may function more efficiently, and with increased lumen output and maximum brightness, due to the elimination of light losses caused by the CFL's integral ballast 6110, as discussed previously.

There may be applications where aesthetic or cosmetic concerns may require the visible reflecting surface of example embodiments that do not have a visible seam line, such as the seam that is created when lenticular or reflection optical films are configured in various example embodiments as described.

Figure 11A:
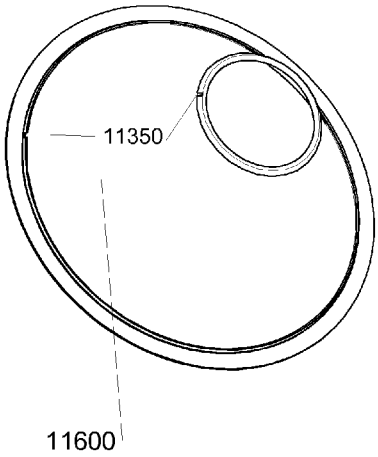
FIG. 11A depicts a top perspective views of an example embodiment of reflector with a clear or translucent cone structure.
Figure 11B:
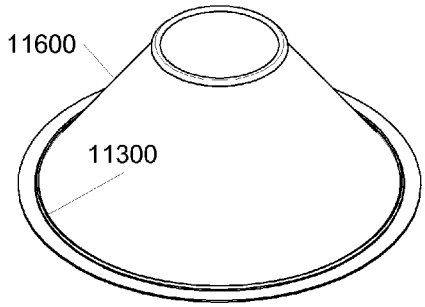
FIG. 11B depicts a different top perspective view of the example embodiment of reflector with a clear or translucent cone structure depicted in FIG. 11A.
Figure 11C:
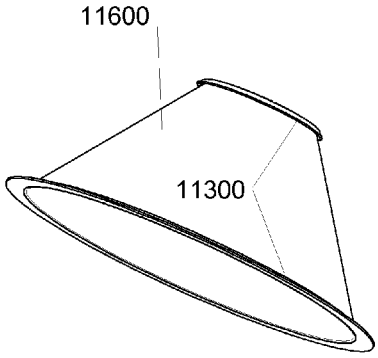
FIG. 11C depicts a different perspective view of the example embodiment of reflector with a clear or translucent cone structure depicted in FIG. 11A.

Another example light reflector will now be described now in accordance with another example embodiment. FIG. 11A and FIG. 11B show a top perspective view of an example embodiment, and FIG. 11C shows a side perspective view. In an example embodiment, the cone structure 11600 may function as an optical film support structure disposed closest to the light source, and a lenticular optical film and rear reflection film may be disposed on the back surface of the cone structure 11600. According to an example implementation, the cone structure may be formed from a clear substrate such as acrylic or polycarbonate, and the surface disposed closest to the light source may have a matt or frosted surface. In an example embodiment, the cone structure may also be formed from various diffusion substrates, such as those utilized in typical acrylic or polycarbonate diffusion lenses for light fixtures. According to example implementations, the cone structure may be manufactured by a process such as injection molding or thermoforming, which may eliminate any visible seam limes on the cone structure. According to certain example implementations, it may be advantageous to configure the diffusion levels of the cone structure to lowest levels needed to obscure the seams of the lenticular optical film, in order to minimize light scatter within the reflector, which may lower the efficiency of the reflector.

Figure 11D:
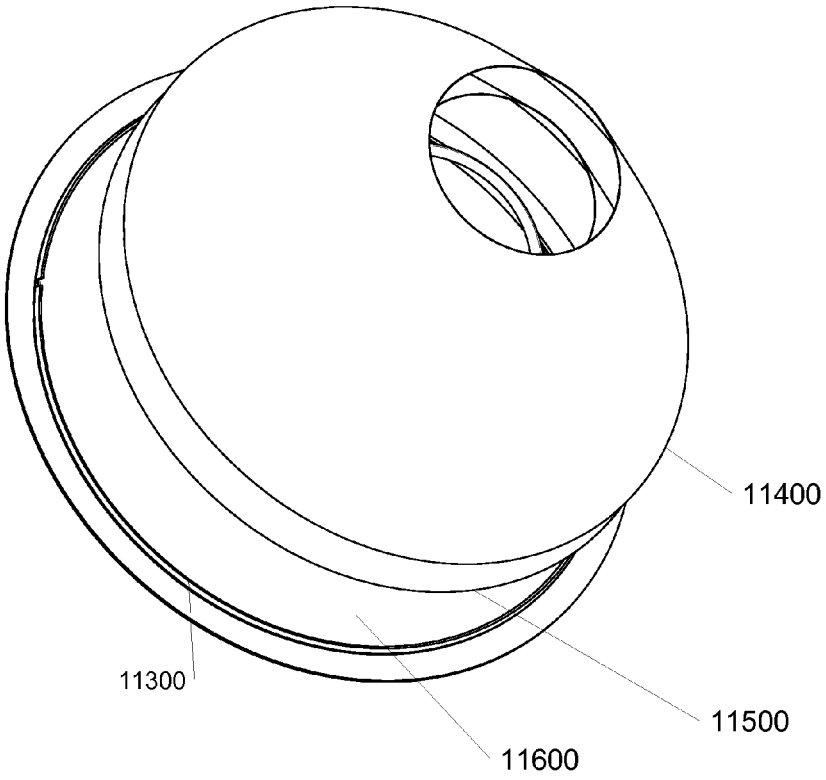
FIG. 11D depicts a top perspective view of the example embodiment of reflector depicted in FIGS. 11A and 11B, including a lenticular and reflection optical film layer.

Referring to FIG. 11A, a pre-sized lenticular optical film piece may be inserted into film holder channels 11300 through film channel slots 11350 until the side straight edges meet or overlap. Similarly, a rear reflection film may also be subsequently inserted. FIG. 11D shows an exploded top perspective view of a lenticular optical film 11500 and rear reflection film 11400 installed on the outside of the cone structure 11600. This figure also shows film holder channels 11300 according to an example implementation.

There may be applications where a light reflector (as described in certain example embodiments) retrofitted into an existing luminaire reflector may have several advantages, including, but not limited to the following:

a) The performance of an existing model line of reflector may be significantly increased without changing other aspects of the product. This may allow modifications to the product with minimal tooling or additional manufacturing costs.
b) The performance of an existing model line of reflector may be significantly increased with relatively low additional labor and materials costs.
c) The lower section of the existing reflector may remain unchanged, and because this section may be the most visible part of the reflector, the overall visual and aesthetic aspects of the reflector may remain relatively unchanged.
d) Certain optical performance features of the existing reflector may remain relatively unchanged because the lower section of the existing reflector remains unchanged.

Figure 12A:
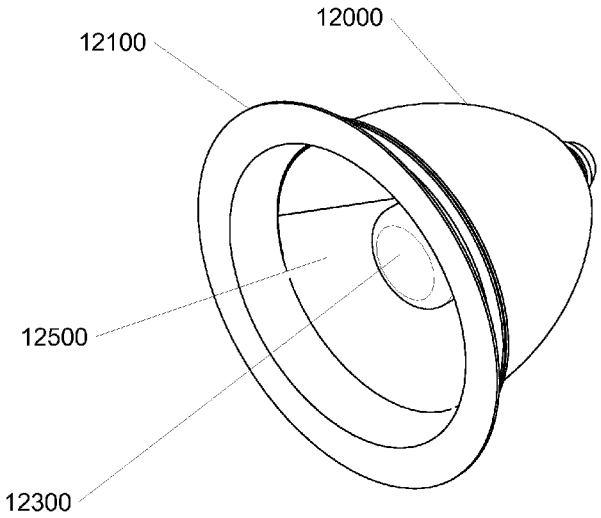
FIG. 12A depicts a perspective view of an existing commercial downlight reflector with an example embodiment of retrofit reflector attached.

An example embodiment of luminaire light reflector retrofit will now be described. FIG. 12A shows a perspective view of a luminaire light reflector. In this example, a recessed downlight, with the example embodiment of luminaire light reflector retrofit attached is shown, and FIG. 12B shows an exploded perspective view of the same retrofit.

In this example embodiment of luminaire light reflector retrofit, a cone shaped lenticular optical film 12500 may be retrofitted inside an existing downlight reflector. The existing downlight reflector may comprise two sections, which may be separated. It may be preferable, but not necessary, that the existing luminaire light reflector have two sections. However, having two sections creates a natural boundary line, which may serve to conceal the optical film edges, and may create a more preferable look. In this example embodiment, the existing luminaire light reflector may include a lower section 12100, and an upper section 12000, and a lamp 12300 which may be disposed inside. In an example implementation, a cone shaped lenticular optical film 12500 (and optional reflection film 12400) may be configured in a similar manner to other example embodiments described herein, and tabs 12550 along the circumference of the openings may be configured into the cutting template so that the films may include the tabs 12550. In accordance with an example implementation, the tabs 12550 may be bent to an approximate 90-degree angle, as shown, and may be placed over the lip of the upper section 12000 of the existing luminaire light reflector. In accordance with an example embodiment, adhesive tape may be used to temporarily secure the tabs 12550 to the lip of the upper section 12000. In an example implementation, the lower section 12100 may then be attached to the upper section 12000 to be firmly attach the hollow cone shaped lenticular optical film 12500 to the existing luminaire light reflector. Attachment of the films utilizing tabs as described, have the advantage of keeping the luminaire light reflector retrofit securely attached with the use of adhesives without compromising the aesthetic look of the retrofit. For example, adhesive or adhesive tape used on either the smooth or the structured side of the lenticular optical film 12500 may be clearly visible, and aesthetically unpleasing. However, in certain example embodiments, clear adhesive tape may be used along the circumference of the small opening of the lenticular optical film cone at one or more locations as necessary, to secure the required cone shape. As with some or all of the other example embodiments described herein, the lenticular optical film may be configured with the structured surface facing the lamp 12300 or away from the lamp 12300, with resultant effects as previously discussed.

According to an example implementation, an optional reflective optical film 12400 may also be utilized in the example embodiment, and may be configured and attached in a similar manner as the lenticular optical film 12500, as describe above. For example, the inclusion of a rear optical film 12400 may have the effect of increasing the efficiency of the luminaire light reflector retrofit.

Figure 12B:
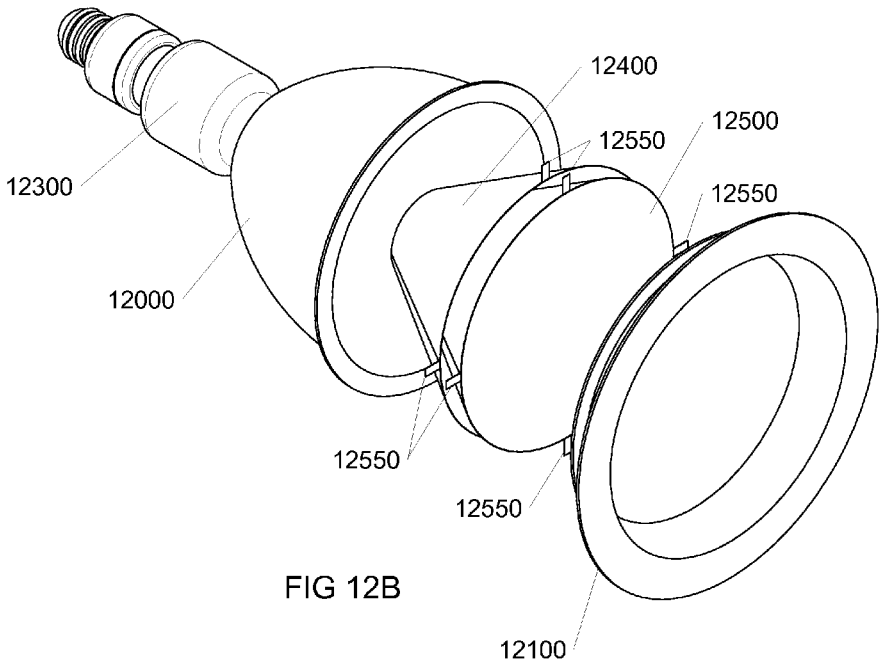
FIG. 12B depicts an exploded perspective view of the existing commercial downlight reflector with an example embodiment of retrofit reflector attached as depicted in FIG. 12A.

In the example embodiment described and shown in FIG. 12A and FIG. 12B, the outer edges along the circumference of the lenticular optical film 12500, and optional reflector film 12400 may follow the seam between the two sections of the existing reflector 12000 and 12100, and this seam line may function to minimize the appearance of the exposed edges of the films, and create a cleaner and more aesthetic look. It may also create a visually pleasing transition between the existing reflector's reflection surfaces to the retrofit reflector's surface.

According to certain example implementations, the luminaire light reflector retrofit may also be attached to the existing luminaire reflector in other ways. For example, the optional reflection surface may be fabricated from relatively thick reflection film that is supplied in sheet form, such as Furukawa MCPET, which is about 1 mm thick, and when formed into a cone such as reflective film 12400, may create a significantly rigid structure. Adhesive tape may be used on the backside of the reflector 12400 to secure the shape of the cone. This rigid cone, when sized to the appropriate dimensions, may fit tightly along the seam line. Adhesive may be used to further secure the cone to the existing reflector's surface. Tabs on the lenticular optical film may be bent to about 180 degrees, and wrapped around the back of the rigid cone and secured with adhesive or adhesive tape, which may serve to secure the lenticular optical film to the reflection film 12400. Tabs along the circumference of the small opening of the lenticular optical film 12500 may also be added and utilized, to further secure the lenticular optical film 12500 to the reflection film 12400. The reflection film may be of any thickness that is suitably rigid for the specific application, according to example embodiments. In one example implementation, the cone shape structure of the reflection surface 12400 may be achieved by thermoforming the reflection material. This may have the advantage of having no seam line where the two edges of the reflection material meet, and may provide greater rigidity and easier installation.

Figure 15:
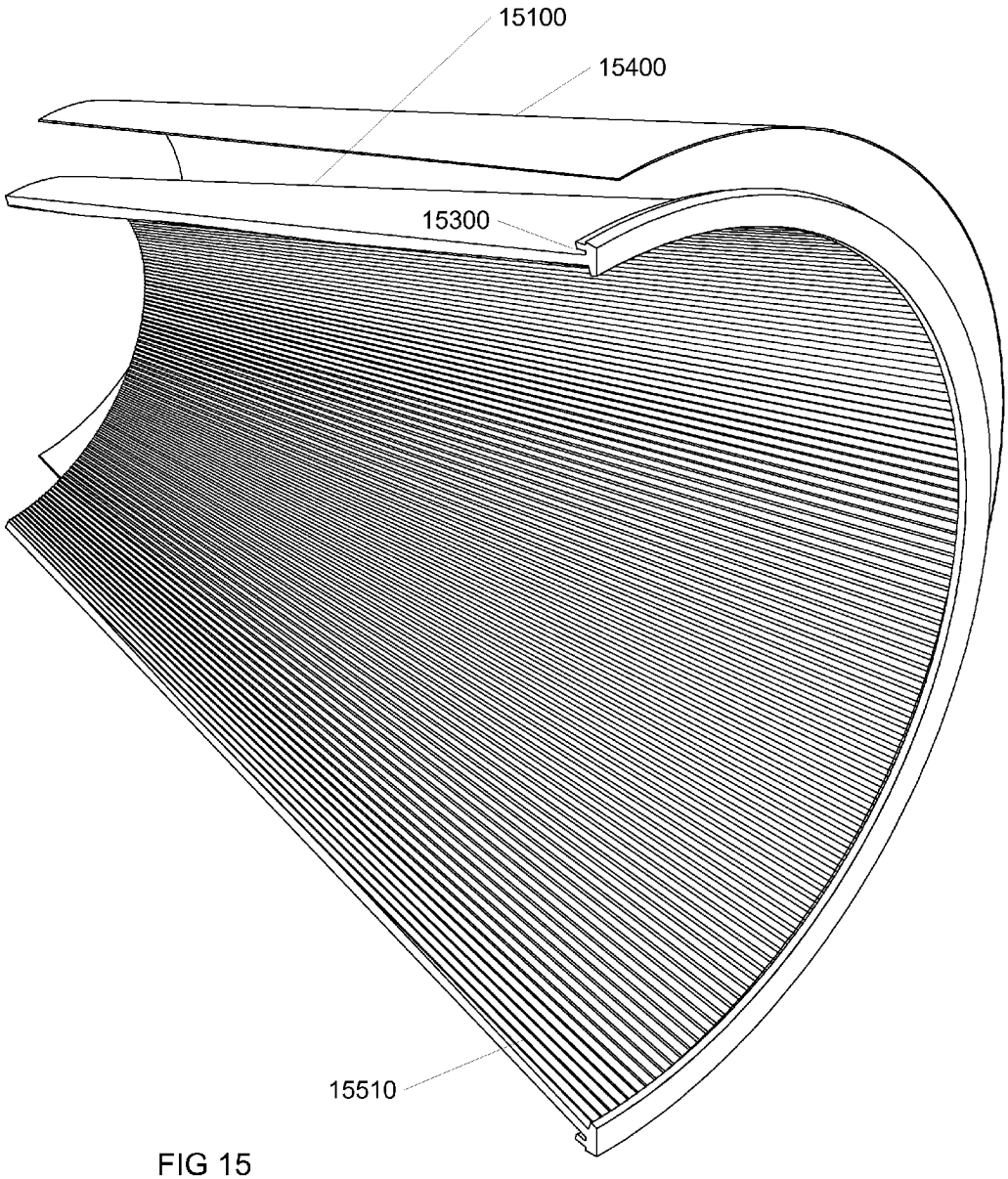
FIG. 15 depicts a perspective cutaway view of an example embodiment of light reflector.
Figure 16:
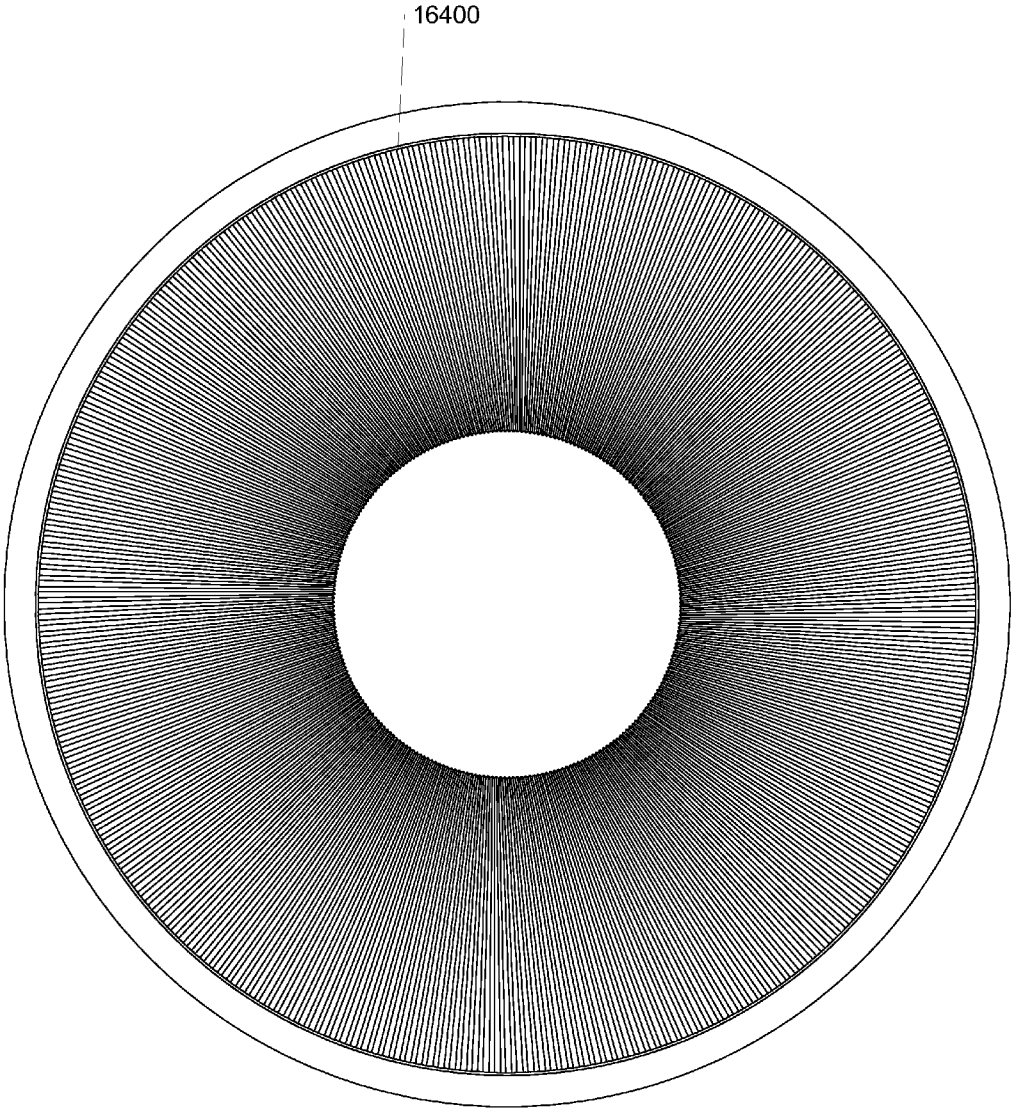
FIG. 16 depicts a plan view of the example embodiment depicted in FIG. 15

FIG. 15 depicts a perspective cross sectional view of another example embodiment of luminaire light reflector. In this example embodiment, a reflector cone 15100 may include a clear substrate such as acrylic or polycarbonate, and may have prism rows formed into the substrate. In an example implementation, the reflector shell 15200 may be fabricated by injection molding, thermoforming or any suitable manufacturing method. According to an example implementation, the size of the prism rows may be dictated by the limitations of the particular manufacturing method used, but it may be preferable from an optical performance standpoint to have the prism rows as small as possible. In one example embodiment, the alignment of the prism rows 15510 may be vertical as shown in FIG. 15. In an example implementation, the reflection film 15400 may be disposed around the back of the reflector cone 15100, and fit into film channel 15300, and may be configured such that that opposing edges of the film overlap, and the overlapping sections may be secured to each other with adhesive or tape etc. Other methods may be utilized for securing the reflection film 15400 to the reflector cone 15100 without departing from the scope of the disclosed technology. FIG. 16 depicts a plan view of the large opening of the reflector, showing example prism rows 16400.

The above described example embodiment may have several advantages over other embodiments. For example, this example embodiment may be made without seam lines that would otherwise be visible if a lenticular optical film was utilized, and which may be aesthetically preferable in some applications. Typical prismatic film may have a high gloss finish and exhibit relatively specular reflection characteristics, which may not be visually acceptable in some applications. According to an example implementation, the surface of the example embodiment described with respect to FIG. 15 and FIG. 16 may exhibit less specular reflection characteristics as compared with embodiments described earlier with respect to cone reflector assemblies that utilize reflector films and/or lenticular films. The aesthetic appeal of prism rows that are visible to the eye may also be advantageous in some applications. The reflector shell also functions as the lenticular film, which may enable manufacturing cost savings.

Figure 17:
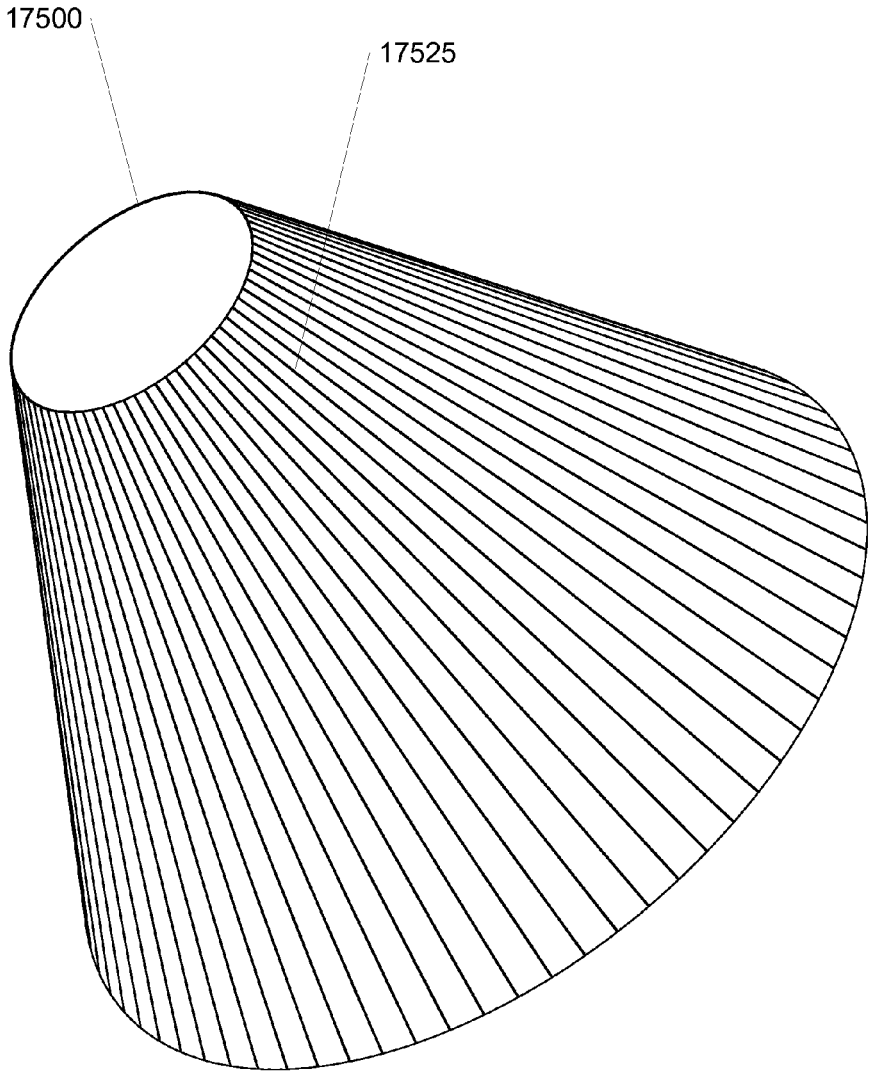
FIG. 17 depicts a lenticular optical film from an example embodiment of light fixture wherein the lenticular optical film has score lines

In any of the example embodiments described herein, vertical lines, such as score lines, may be created in any of the optical films in order to mask the appearance of the film seams. For example, FIG. 17 depicts a drawing of a cone shaped prism film 17500, which has vertical lines 17525 that have been scored onto the back of the film. The lines may be cut into the film manually with a sharp tool, or with automated machines, such die cutting, scoring machines, cutting plotters such as those made by Graphtec America, etc. It may be preferable that the sections between the lines are of equal size. In example embodiments that have a scored film as in the above example, the reflector may appear to have a multi-facet configuration, which may create a pleasing look. The edges where the prism film join together may appear to the eye to be any of the score lines as described, which might effectively mask the appearance of the seam. The result may be more effective if a diffusion film as described in other example embodiments is disposed on top of the prism film. Score lines may be configured on either side of the lenticular optical film layer, or either side of a diffusion layer (if one is utilized).

According to an example embodiment, a lamp retrofit apparatus or lamp reflector will be described, which may have some or all the advantages of example embodiments of lamp retrofit apparatuses or lamp reflectors previous described, but may also have the advantage of having a very low manufacturing cost, and a very light weight.

Figure 18A:
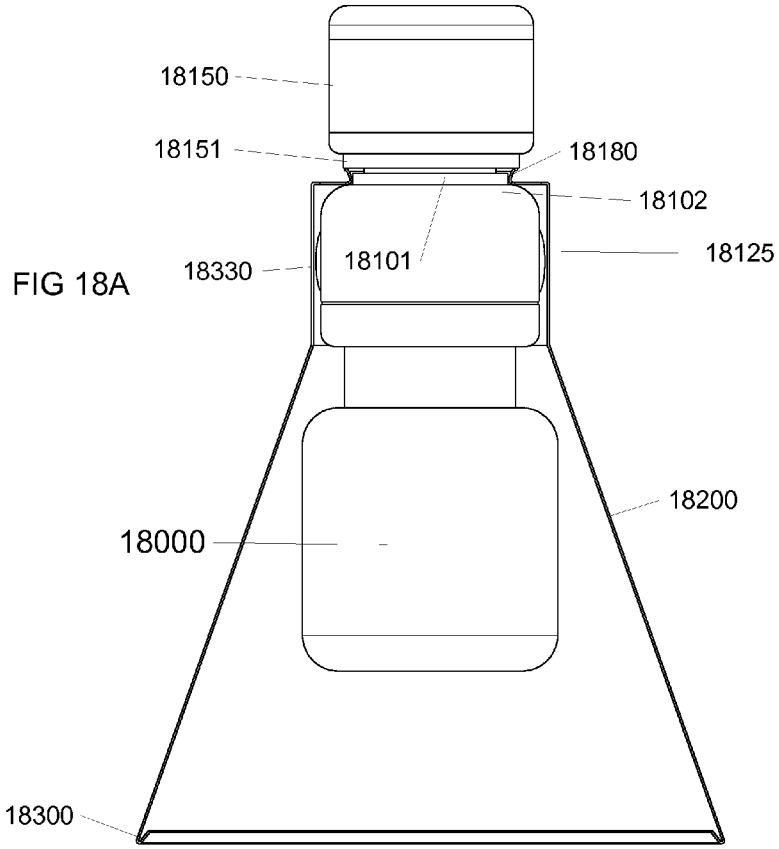
FIG. 18A depicts a side cutaway view of an example embodiment of lamp reflector retrofit attached to a CFL.
Figure 18B:
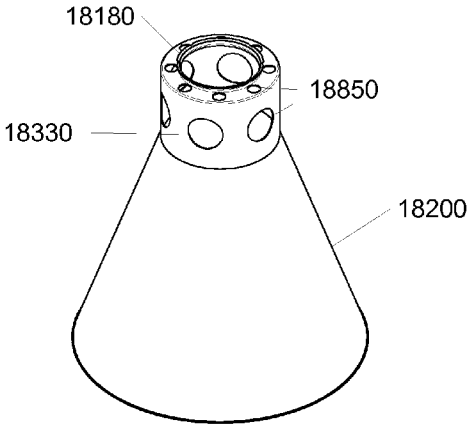
FIG. 18B depicts a perspective view of the example embodiment of lamp reflector retrofit depicted in FIG. 18A, without the CFL.
Figure 18C:
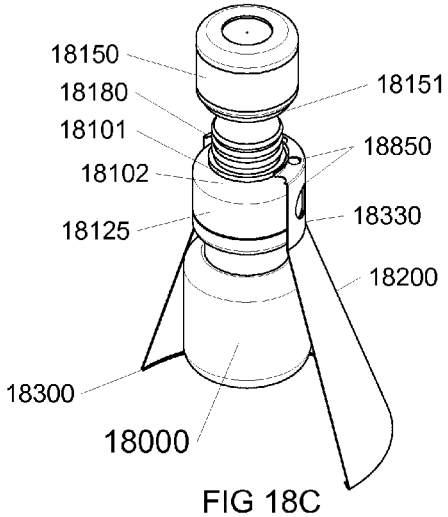
FIG. 18C depicts a perspective cutaway view of the example embodiment of lamp reflector retrofit depicted in FIG. 18A.

Referring to FIG. 18A, FIG. 18B and FIG. 18C, the reflector support cone 18200 may function as a one-piece mounting structure for optical films as described herein in the other example embodiments, and may include a device for attachment to a lamp. In an example implementation, the reflector support cone 18200 may be manufactured out of a suitable heat resistant plastic, using a suitable mass production method such as thermoforming or injection molding for example. Thermoforming may have the advantage of lower per unit cost, as well as lower tooling costs. The thickness of the reflector support cone 18200 may only need to be as thin as the chosen manufacturing method will allow. An example of a suitable thickness may be that of a disposable plastic drinking cup, which may have acceptable rigidity for the application.

According to an example implementation of the disclosed technology, the optical films may be mounted similar to other example embodiments described herein, wherein the film edges along the bottom opening of the cone nest in film channel 18300.

A standard Edison socket 18150 that may be used in most incandescent downlight enclosures, may be utilized in certain example embodiments of the disclosed technology. The Edison socket 18150 may have a collar 18151 around the opening of the socket. A typical self-ballasted CFL 18000 may have gap 18101 between its ballast 18125 and its Edison screw. A gap 18101 may be adjacent to the curved or angles section 18102 of the ballast 18125. A reflector cone 18200 may be configured, according to an example embodiment, with a flange 18180 similar to the one shown in FIG. 18A. The actual shape of the flange may be any suitable shape or dimension for the application.

When a self-ballasted CFL 18000 is inserted into the reflector cone 18200, an Edison screw may protrude through an opening of the reflector cone 18200. When the CFL 18000 is screwed into the Edison socket 18150, a flange 18180 may compress against the Edison socket collar 18151 and the curved or angled section 18102 of CFL 18000, which may serve to hold the reflector cone 18200 secure and aligned with the CFL 18000. Ventilation holes 18850 may serve to lower the lamp and ballast operating temperatures.

Although the example embodiment, as shown in FIGS. 18 A, 18B and 18C, has a collar 18330 that may surround the CFL integral ballast 18125, another example embodiment may be configured without collar 18330. Although the efficiency of the reflector may be reduced due to optical interference and absorption from the ballast 18125, the manufacture of the reflector cone 18200 may better lend itself to being thermoformed. In an example embodiment without collar 18330, vent holes may be configured into the reflector cone 18200 near the top opening. Corresponding holes in the optical films may need to be configured appropriately for hole alignment once the films are mounting into the reflector cone 18200.

According to an example embodiment, a lamp retrofit apparatus or lamp reflector will be described, which may have some or all the advantages of example embodiments of lamp retrofit apparatuses or lamp reflectors previous described, but may also have the advantage of an even lower manufacturing cost, and light weight.

Figure 20:
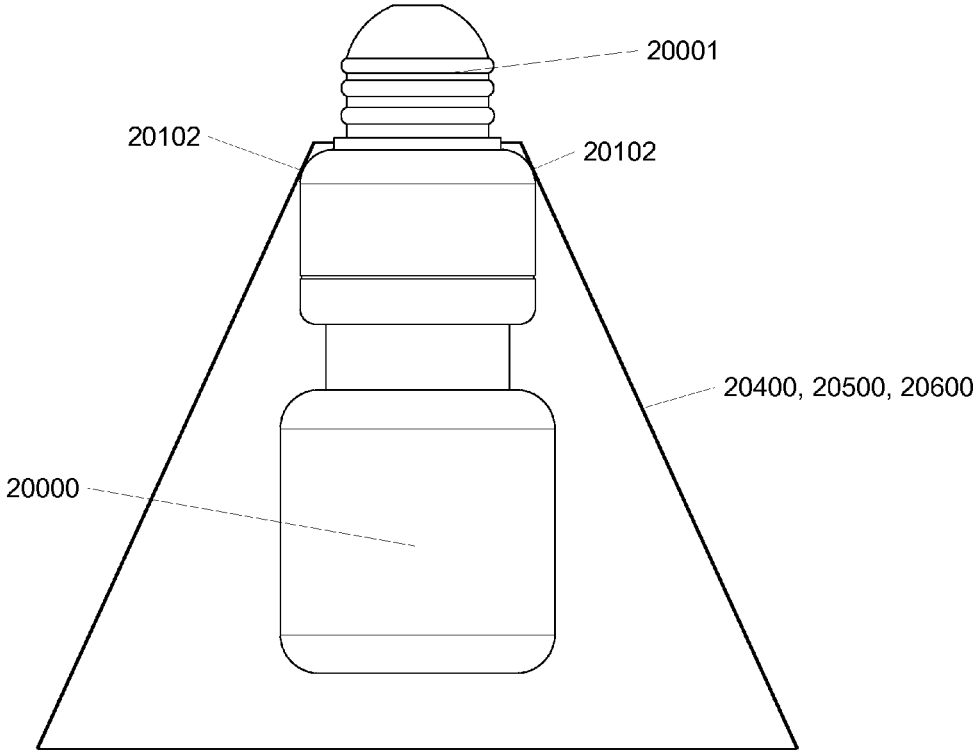
FIG. 20 depicts a side cutaway view of an example embodiment of lamp retrofit apparatus or lamp reflector apparatus, which does not utilize a film support structure.

FIG. 20 shows a cutaway side view of a reflector film 20400, a lenticular optical film 20500, and an optional diffusion film 20600 configured into a cone shape (in a similar manner to other example embodiments), but without any film support structure, and mounted on a CFL 20000. In an example embodiment, a self-ballasted CFL 20000 may be inserted into the reflector cone until the inner surface of the cone contacts the edge 20102 of the ballast, and wherein the Edison screw 20001 of the CFL 20000 may protrude through the small opening of the cone. Before the films are configured into the cone shape, adhesive such as adhesive transfer tape or adhesive putty may be placed on the area of the inside surface of the optical film closest to the light source, and in the area that will make contact with the ballast surface 20102. This may serve to make the area "tacky", wherein once the example embodiment is mounted on the CFL, its alignment may be adjusted and remain secure in the adjusted position. This technique for mounting the optical films may allow for repeated adjustment of the example embodiment or for the reuse on subsequent CFLs. It may be preferable to utilize an adhesive that will not dry out, and will remain tacky over long periods of time, and under elevated temperatures. Vent holes may be configured into the optical films 20400, 20500, 20600 that may serve to lower the ballast and lamp operating temperature.

Another example embodiment of luminaire light reflector retrofit that may be inserted and attached into an existing downlight reflector will now be described. Downlight reflectors may typically be available in a "full cone" style that may be suitable for either an incandescent lamp or CFL, or incandescent style reflectors with open backs that are primarily designed to be used with reflector style lamps, such as Par 38, R30, R40 etc. These incandescent style reflectors, which mount in incandescent recessed housings, typically have open backs, and are typically very low cost. Since they may be designed for use with reflector style lamps (wherein light from the lamps may have little interaction with the reflector surface) they may have very poor optical performance and efficiency when used with non-reflector style lamps such as spiral CFLs. This poor performance may be due to the relatively poor reflection efficiency of the reflector surface, the reflector's shape, and the open back that allows a significant portion of light to become trapped in the back of the light fixture enclosure cavity.

Full cone style reflectors may have substantially improved optical performance compared to open back reflectors when used with non-reflector style lamps. Despite this improved performance, full cone reflectors may exhibit significantly improved optical performance when retrofitted with this example embodiment of luminaire light reflector.

Accordingly, if the user desires to utilize existing downlight reflectors as previously described, and fit the fixture with CFL lamps (for example, as an energy saving retrofit), the typical choice would be to either fit the fixture with spiral CFLs or reflector style CFLs. Reflector style CFLs may have relatively good performance in the described reflectors, because relatively little of the light output from the lamp interacts with the reflector. However, they may have the disadvantage of being significantly more expensive than standard spiral CFLs, and may have very wide beam angles, which may not be able to approximate the light distribution characteristics of narrower beam incandescent lamps. Spiral CFLs may be significantly less expensive, which is advantageous, however as previously stated, the optical performance might be very poor in the previously described reflectors. Spiral CFLs also have the disadvantage of only a very wide beam angle.

Example embodiment described herein may have several advantages over conventional downlight reflectors. When spiral CFLs are utilized in downlight reflectors, such as open back reflectors retrofitted with the example embodiment of light reflector, optical efficiency may be increased up to 100% and maximum brightness may be increased by up to 200%, with a significantly narrower beam angle. This may allow the end user to fit the downlight fixture with a spiral CFL with ½ the rated wattage, which may result into an energy savings of up to 100%, while maintaining a similar light output level. The end user may also choose to utilize not to reduce the lamp wattage, and to utilize the increased light output and brightness. The optical efficiency and maximum brightness of the retrofitted reflector as described may also be significantly increased compared to a non-retrofitted reflector fitted with an equivalent wattage reflector style CFL. Since spiral CFLs are significantly less expensive than reflector style CFLs, the example embodiment of retrofit reflector may allow significant cost savings.

Figure 19A:
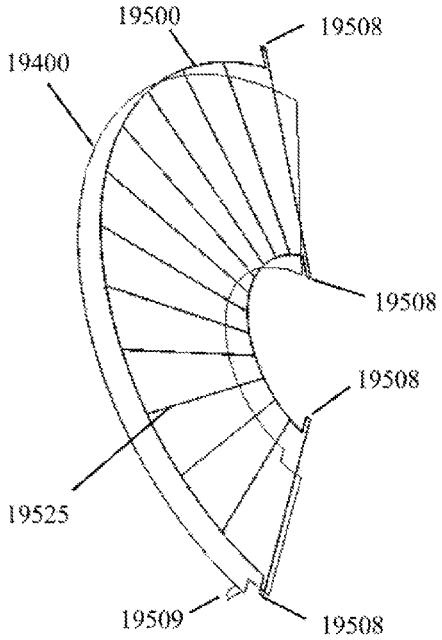
FIG. 19A depicts a perspective exploded view of a flat lenticular optical film and a flat reflection film configured to form an example embodiment of luminaire reflector retrofit.
Figure 19B:
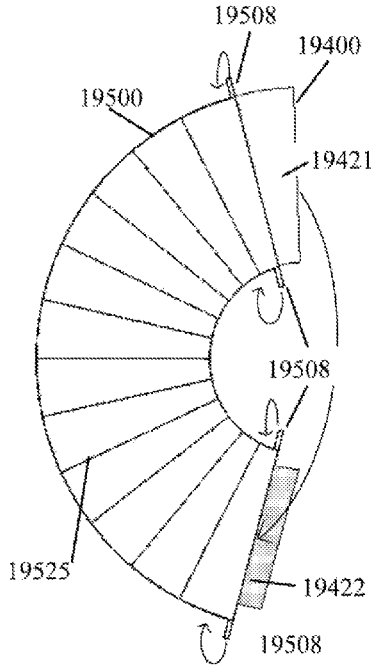
FIG. 19B depicts a perspective view of the flat lenticular optical film and flat reflection film depicted in FIG. 19A.
Figure 19C:
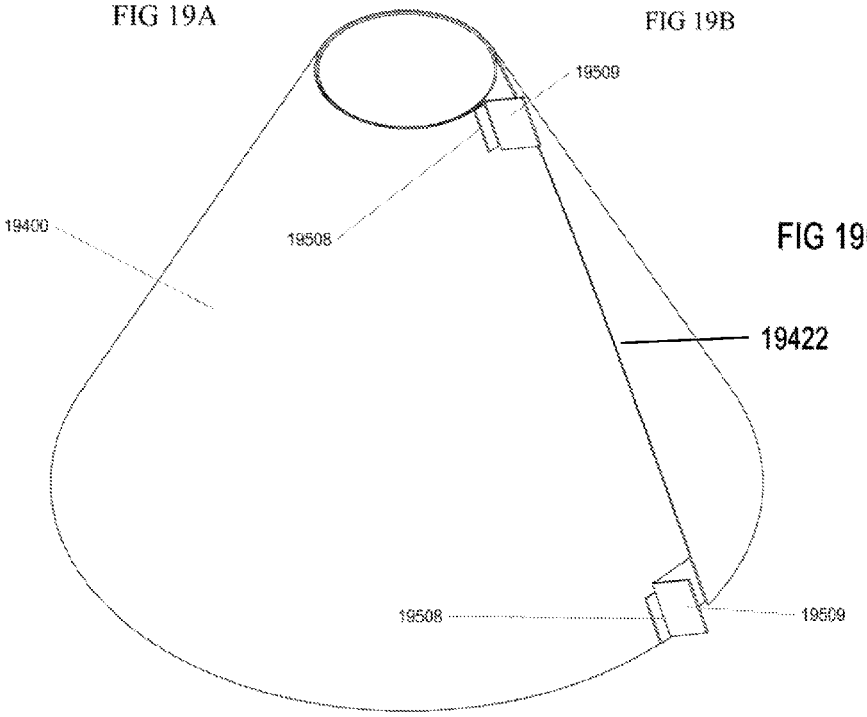
FIG. 19C depicts a perspective view of the example embodiment of luminaire reflector retrofit.

Referring to FIG. 19A, a perspective exploded view is shown of a lenticular optical film 19500 and reflection film 19400 which have been cut to the appropriate size to form a cone when coiled and fastened, as shown in FIG. 19C. FIG. 19B shows a plan view of the same films when aligned and lying flat. Referring to FIG. 19B, score lines 19525 in the lenticular film 19500 are shown, and function to minimize the appearance of the seam line, as described previously. In an example implementation, the lenticular film 19500 may include tabs 19508 which may be folded about 180 degrees backwards and around the back surface of the reflection film 19400, as shown by the arrows. Referring to FIG. 19C, tabs 19509 may be cut into the reflection film 19400 such that when the film assembly is flat an aligned such as in FIG. 19B, the reflection film tabs 19509 may be folded over top of prism film tabs 19508. According to an example implementation, the tabs may be attached to the reflection layer surface 19400 with adhesive tape or any suitable attachment means. This method of using tabs 19509 to secure the prism film tabs 19508 has the advantage that the lenticular film 19500 may be free to rotate axially relative to the reflection film 19400 when the film assembly is coiled into a cone shape, which may eliminate any "bunching" or gaps between the two films due to the small difference in diameters.

Alternatively, all four tabs 19508 may be fastened to the reflection film surface 19400 when the film ensemble is flat, provided the two films are aligned precisely so that when coiled into the cone, there will be no excess gaps or bunching. It has been noted that when the tabs 19508 are adhered precisely to the reflection film 19400 with adhesive tape as described, and the film ensemble is subsequently coiled into and secured into its final cone shape, that the lenticular optical film 19500 may initially exhibit distortions caused by "bunching". However, the distortions may subside after manual pressure is applied to the gaps. It has been found that this method of fastening the tabs 19508 to the reflection film may ultimately exhibit the least the least amount of gaps between the two film surfaces.

As shown in FIG. 19B, a first fastening section 19421 and a second fastening section 19422 of reflection film 19400 may be configured to protrude beyond the flat edges of lenticular film 19500 to enable and facilitate forming and fastening of the flat film assembly into the final cone shape. When the film assembly is coiled, the first fastening section 19421 may be inserted between the reflection film 19400 and lenticular film 19500 on the opposite edge of the lenticular film's edge as shown by the arrow. The tabs on the lenticular film 19508 that are fastened to the reflection film as described above may function as a channel for the first fastening section 19421 to slide into and align the top and bottom edges. The advantage of this method may be that when the cone shape is formed, the two flat edges of the lenticular film 19500 may butt together, which may function to minimize the appearance of the seam. If the lenticular film 19500 edges overlap, the appearance of the seam may become significantly more noticeable. The inner surface of the first fastening section 19421 may be visible underneath the lenticular film, and accordingly, the flat edge of the first fastening section 19421 may be visible and appear as a seam. To minimize the appearance of this seam, the first fastening section 19421 may be configured such that when the ensemble is formed into the cone, the edge aligns with the first score line on the lenticular film adjacent to the flat edge.

When formed into the cone, and according to an example implementation, the second fastening section 19422 of the reflection film may overlap the reflection film on the opposite side as shown in FIG. 19C. Adhesive tape such as adhesive transfer tape with a peel off liner may be affixed to the inside of the second fastening section 19422. When the film assembly is formed into the cone and held in place, the liner may be removed and the two surfaces may be pressed together.

As researched by the Applicant, the dimensions of the opening of many commercially available 6" open back reflectors that were tested were found to be similar enough that one size of the example embodiment is suitable for all. The small opening of the example embodiment of retrofit light reflector may be sized such that the diameter of the largest size of CFL integral ballast anticipated may fit through the opening. It has been found that 2" may accommodate most CFL spiral lamps under 30 watts. The depth of the cone, according to example embodiments, may be configured such that when a spiral CFL is fitted in a recessed light fixture that has the lamp depth that has been previously set to accommodate reflector lamps (about 5" in a standard 6" incandescent housing), the integral ballast may substantially protrude through the small opening of the cone. In this example, a 4" cone depth may be appropriate. As previously described, when the example embodiments are configured wherein the integral ballast is substantially outside the cone, optical performance is increased.

In accordance with certain example embodiments, adhesive transfer tape or adhesive putty may be attached to several places around the perimeter of the reflector's base in close proximity to the bottom edge (three or four may be sufficient). With the release liner removed from the putty or adhesive tape, the cone may be carefully raised up into the existing reflector. With the bottom edges of the cone aligned with the lip of the existing reflector, pressure may be applied to the cone at the adhesive's locations to firmly attach the adhesive to the existing reflector.

While some example embodiments of the disclosed technology are directed towards use in downlights, the range of possible applications of the disclosed technology is not limited to downlight applications. For example, many applications where a light source needs to be directed, or have improved efficiency, can benefit by the advantages described with the various example embodiments of the disclosed technology. For example, traffic lights, roadway lights, streetlights, parking lot lights, highbay light fixtures, spot lights, theatrical lights etc., may all be possible applications where benefits and advantages of the disclosed technology may be realized.

As described herein, one example embodiment of the disclosed technology is directed to a hollow cone-shaped light reflector apparatus including two or more nested cone-shaped layers defining a top cone portion having a substantially circular top aperture, and a bottom cone portion having a substantially circular bottom optical aperture that is larger in diameter than the top aperture. In an example embodiment, the apparatus may include an inner cone portion, and an outer cone portion. The two or more nested cone-shaped layers are configured for reflecting light from a light source placed in proximity to the inner cone portion. The two or more nested cone-shaped layers include a reflection layer disposed adjacent to the outer cone portion, wherein the reflection layer has at least a reflection surface that is oriented facing the inner cone portion. The two or more nested cone-shaped layers include a lenticular optical film layer. In an example implementation, the lenticular optical film layer may have a structured surface and a smooth surface. In one embodiment, the lenticular optical film layer may be disposed between the reflection surface of the reflection layer and the inner cone portion. In one embodiment, the structured surface of the lenticular film layer may be oriented facing the inner cone portion. In another embodiment, the smooth surface of the lenticular film layer may be oriented facing the outer cone portion.

In an example embodiment, the hollow cone shaped reflector is further defined by the lenticular optical film layer comprising a prismatic optical film having a structured surface characterized by a plurality of triangular prisms.

In an example embodiment, the hollow cone shaped reflector may be further defined by the lenticular optical film layer comprising a prismatic optical film having a structured surface characterized by a plurality of triangular prisms. According to an example embodiment, triangular prisms may form a plurality of rows with a row direction defined parallel to the rows. In an example implementation, when the lenticular film is formed into a cone structure, the cone shape may be defined by a union of a set of straight lines that connect a common apex point and a base, wherein the base defines a perimeter associated with the bottom aperture. The lenticular optical film layer may further comprise a prismatic optical film having a structured surface characterized by a plurality of triangular prisms. According to an example embodiment the triangular prisms are arranged in a plurality of rows, and wherein at least a portion of the plurality of rows are oriented substantially parallel to one or more of the straight lines that define the hollow cone shape.

According to another example embodiment, at least a portion of the plurality of prism rows are oriented substantially perpendicular to one or more of the straight lines that define the hollow cone shape.

In an example embodiment, the hollow cone shaped reflector is further defined by the two or more nested cone-shaped layers further comprising an optical diffusion film having a structured surface, wherein the optical diffusion film is disposed between the lenticular optical film and the inner cone portion, and wherein the structured surface of the optical diffusion surface is orientated facing the inner portion.

In an example embodiment, the hollow cone shaped reflector may be further defined by the lenticular optical film, which may include a condensing film configured to concentrate light rays.

In an example embodiment, the hollow cone shaped reflector may be further defined by the lenticular optical film comprising a holographic optical film.

In an example embodiment, two or more nested cone-shaped layers define at least a portion of a hollow cone shape defined by a union of a set of straight lines that connect a common apex point and a base, wherein the base defines a perimeter associated with the bottom aperture. The lenticular optical film layer further comprises a plurality of score lines on one or more surfaces associated with the lenticular optical film layer, wherein each of the plurality of score lines are oriented substantially parallel with one or more of the straight lines that define the hollow cone shape.

In an example embodiment, the hollow cone shaped reflector may further be defined by the two or more nested cone-shaped layers defining a luminaire reflector retrofit configured to attach to an inside surface of a luminaire reflector.

In an example embodiment, the hollow cone shaped reflector may further be defined by the two or more nested cone-shaped layers defining a lamp reflector retrofit configured to attach to a lamp.

In an example embodiment, the hollow cone shaped reflector may further be defined by the reflection layer comprising a reflective optical film.

In an example embodiment, the hollow cone shaped reflector may further be defined by the reflection layer comprising an inner surface of a luminaire reflector.

In an example embodiment, the hollow cone shaped reflector may further defined by a mounting structure configured to support the two or more nested cone-shaped layers at least at one point on the bottom cone portion, wherein the mounting structure is further configured to attach to an inside portion of an enclosure cavity associated with a light fixture.

In an example embodiment, the hollow cone shaped reflector may further be defined by a mounting structure configured to support the two or more nested cone-shaped layers at least one point on the top cone portion, wherein the mounting structure is further configured to attach to a compact fluorescent lamp or LED lamp.

In an example embodiment, the hollow cone shaped reflector is further defined by a transparent or translucent cone shaped structure disposed between the lenticular optical film and the inner cone portion.

In an example embodiment, the hollow cone shaped reflector may further defined by the lenticular optical film comprising two or more tabs configured for attaching the lenticular optical film to the reflection layer.

In an example embodiment, the hollow cone shaped reflector may further be defined by the lenticular optical film that includes at least two tabs adjacent to the at the top cone portion or the bottom cone portion, wherein the at least two tabs are configured to attach to the reflection layer such that lenticular optical film is free to axially rotate about the optical axis independent of the reflection layer.

An example embodiment includes a system comprising a light fixture enclosure cavity and two or more nested cone-shaped layers. The two or more nested cone-shaped layers include a top cone portion having a substantially circular top aperture, a bottom cone portion having a substantially circular bottom optical aperture that is larger in diameter than the top aperture, an inner cone portion, an outer cone portion. The two or more nested cone-shaped layers may be configured for reflecting light from a light source placed within the inner cone portion. The two or more nested cone-shaped layers may include a reflection layer disposed adjacent to the outer cone portion, the reflection layer having at least a reflection surface that is oriented facing the inner cone portion. The two or more nested cone-shaped layers may include a lenticular optical film layer. In one example embodiment, the lenticular optical film layer may include a smooth surface and a structured surface. In an example implementation, the lenticular optical film layer may be disposed between the reflection surface of the reflection layer and the inner cone portion. In one example embodiment, the structured surface may be oriented facing the inner cone portion. In one example embodiment, the structured surface may be oriented facing the outer cone portion.

In an example embodiment, the system further comprises a mounting structure configured to support the two or more nested cone-shaped layers, wherein the mounting structure is further configured to attach to the light fixture enclosure cavity.

An example embodiment of the disclosed technology includes an optical film support system may include a hollow cone shaped structure having a top aperture and a bottom aperture, wherein the bottom aperture is larger than the top aperture. The hollow cone shape structure may further include one or more channels disposed along an inner periphery of the hollow cone shaped structure at the bottom aperture, wherein the one or more channels are configured to secure optical film.

In an example embodiment, the one or more channels of the optical film support system may be substantially "V" shaped. In an example embodiment, the one or more channels of the optical film support system may be substantially "L" shaped. In an example embodiment, the one or more channels of the optical film support system may be substantially or "U" shaped. In an example implementation, an edge associated with one or more optical films may be disposed substantially inside the one or more film channels, wherein the one or more optical films may be held secure and flat along an inner surface of the hollow cone shaped structure.

In an example embodiment, the optical film support system may further include one or more channels disposed along an inner periphery of the hollow cone shaped structure at the top aperture, wherein the one or more channels are configured to secure optical film.

This written description uses examples to disclose the disclosed technology, including the best mode, and to enable any person skilled in the art to practice the disclosed technology, including making and using any devices or systems and performing any incorporated methods. The patentable scope of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

I claim:

1. A hollow cone-shaped light reflector apparatus comprising:

two or more nested cone-shaped layers defining:

a top cone portion having a substantially circular top aperture;

a bottom cone portion having a substantially circular bottom optical aperture that is larger in diameter than the top aperture;

an inner cone portion; and an outer cone portion;

wherein the two or more nested cone-shaped layers are configured for reflecting light from a light source placed in proximity to the inner cone portion, and wherein the two or more nested cone-shaped layers comprise:

a reflection layer disposed adjacent to the outer cone portion, the reflection layer having at least a reflection surface that is oriented facing the inner cone portion; and a lenticular optical film layer disposed between the reflection surface of the reflection layer and the inner cone portion.

2. The apparatus of claim 1, wherein the lenticular optical film layer comprises a prismatic optical film having a structured surface characterized by a plurality of triangular prisms.

3. The apparatus of claim 1, wherein the lenticular optical film layer comprises a structured surface and a smooth surface, wherein the structured surface of the lenticular optical film layer faces the outer cone portion.

4. The apparatus of claim 1, wherein the lenticular optical film layer comprises a structured surface and a smooth surface, wherein the structured surface of the lenticular optical film layer faces the inner cone portion.

5. The apparatus of claim 1, wherein the two or more nested cone-shaped layers define at least a portion of a hollow cone shape defined by a union of a set of straight lines that connect a common apex point and a base, wherein the base defines a perimeter associated with the bottom aperture, and wherein the lenticular optical film layer further comprises a prismatic optical film having a structured surface characterized by a plurality of triangular prisms, wherein the triangular prisms are arranged in a plurality of rows, wherein at least a portion of the plurality of rows are oriented substantially parallel to one or more of the straight lines that define the hollow cone shape.

6. The apparatus of claim 1, wherein the two or more nested cone-shaped layers define at least a portion of a hollow cone shape defined by a union of a set of straight lines that connect a common apex point and a base, wherein the base defines a perimeter associated with the bottom aperture, and wherein the lenticular optical film layer further comprises a prismatic optical film having a structured surface characterized by a plurality of triangular prisms, wherein the triangular prisms are arranged in a plurality of rows, wherein at least a portion of the plurality of rows are oriented substantially perpendicular to one or more of the straight lines that define the hollow cone shape.

7. The apparatus of claim 1, wherein the two or more nested cone-shaped layers further comprise a cone shaped optical diffusion film having at least one structured surface, wherein the optical diffusion film is disposed between the lenticular optical film and the inner cone portion, and wherein the at least one structured surface of the optical diffusion film is orientated facing the inner cone portion.

8. The apparatus of claim 1, wherein the lenticular optical film layer comprises a diffusion film configured to concentrate light rays.

9. The apparatus of claim 1, wherein the lenticular optical film layer further comprises a holographic optical film.

10. The apparatus of claim 1, wherein the two or more nested cone-shaped layers define at least a portion of a hollow cone shape defined by a union of a set of straight lines that connect a common apex point and a base, wherein the base defines a perimeter associated with the bottom aperture, and wherein the lenticular optical film layer further comprises a plurality of score lines on one or more surfaces associated with the lenticular optical film layer, wherein each of the plurality of score lines are oriented substantially parallel with one or more of the straight lines that define the hollow cone shape.

11. The apparatus of claim 1, wherein the two or more nested cone-shaped layers further comprise a cone shaped optical diffusion film having at least one structured surface, wherein the optical diffusion film is disposed between the lenticular optical film and the inner cone portion, and wherein the at least one structured surface of the optical diffusion film is orientated facing the inner cone portion, and wherein the two or more nested cone-shaped layers define at least a portion of a hollow cone shape defined by a union of a set of straight lines that connect a common apex point and a base, wherein the base defines a perimeter associated with the bottom aperture, and wherein the diffusion film further comprises a plurality of score lines on one or more surfaces associated with the diffusion film, wherein each of the plurality of score lines are oriented substantially parallel with one or more of the straight lines that define the hollow cone shape.

12. The apparatus of claim 1, wherein the two or more nested cone-shaped layers define a luminaire reflector retrofit configured to attach to an inside surface of a luminaire reflector.

13. The apparatus of claim 1, wherein the two or more nested cone-shaped layers define a lamp reflector retrofit configured to attach to a lamp.

14. The apparatus of claim 1, wherein the reflection layer comprises a reflective optical film.

15. The apparatus of claim 1, wherein the reflection layer comprises an inner surface of a luminaire reflector.

16. The apparatus of claim 1, further comprising a mounting structure configured to support the two or more nested cone-shaped layers at least at one point on the bottom cone portion, wherein the mounting structure is further configured to attach to an inside portion of an enclosure cavity associated with a light fixture.

17. The apparatus of claim 1 further comprising a mounting structure configured to support the two or more nested cone-shaped layers at least one point on the top cone portion, wherein the mounting structure is further configured to attach to a compact fluorescent lamp or LED lamp.

18. The apparatus of claim 1, further comprising a transparent or translucent cone shaped structure disposed between the lenticular optical film layer and the inner cone portion.

19. The apparatus of claim 1, wherein the lenticular optical film comprises two or more tabs configured for attaching the lenticular optical film layer to the reflection layer.

20. The apparatus of claim 1, wherein the lenticular optical film layer comprises at least two tabs adjacent to the top cone portion or the bottom cone portion, wherein the at least two tabs are configured to attach to the reflection layer such that lenticular optical film layer is free to axially rotate independently from the reflection layer.

21. A system comprising:

a light fixture enclosure cavity; and two or more nested cone-shaped layers defining:

a top cone portion having a substantially circular top aperture;

a bottom cone portion having a substantially circular bottom optical aperture that is larger in diameter than the top aperture;

an inner cone portion; and an outer cone portion;

wherein the two or more nested cone-shaped layers are configured for reflecting light from a light source placed within the inner cone portion, and wherein the two or more nested cone-shaped layers comprise:

a reflection layer disposed adjacent to the outer cone portion, the reflection layer having at least a reflection surface that is oriented facing the inner cone portion; and a lenticular optical film layer disposed between the reflection surface of the reflection layer and the inner cone portion.

22. The system of claim 20, further comprising a mounting structure configured to support the two or more nested cone-shaped layers, wherein the mounting structure is further configured to attach to the light fixture enclosure cavity.

23. The system of claim 20, wherein the lenticular optical film layer comprises a structured surface and a smooth surface, wherein the structured surface of the lenticular optical film layer is oriented to face the outer cone portion.

24. The system of claim 20, wherein the lenticular optical film layer comprises a structured surface and a smooth surface, wherein the smooth surface of the lenticular optical film is oriented to face the outer cone portion.

25. An optical film support system comprising:

a hollow cone shaped structure having a top aperture and a bottom aperture, wherein the bottom aperture is larger than the top aperture, the hollow cone shape structure further including one or more channels disposed along an inner periphery of the hollow cone shaped structure at the bottom aperture, wherein the one or more channels are configured to secure optical film.

26. The system of claim 24, wherein the one or more channels are substantially "V" shaped, "L" shaped or "U" shaped, and wherein an edge associated with one or more optical films is disposed substantially inside the one or more film channels, wherein the one or more optical films are held secure and flat along an inner surface of the hollow cone shaped structure.

27. The system of claim 24, wherein the hollow cone shape structure further comprises one or more channels disposed along an inner periphery of the hollow cone shaped structure at the top aperture, wherein the one or more channels are configured to secure optical film.

* * * * *